US007784976B2

(12) United States Patent
Chon

(10) Patent No.: US 7,784,976 B2
(45) Date of Patent: Aug. 31, 2010

(54) LIGHTING APPARATUS

(75) Inventor: Su-gon Chon, Seoul (KR)

(73) Assignees: Yasuo Inoue (JP); ICL-Newtec Co., Ltd. (KR)

( * ) Notice: Subject to any disclaimer, the term of this patent is extended or adjusted under 35 U.S.C. 154(b) by 0 days.

(21) Appl. No.: 11/722,326

(22) PCT Filed: Feb. 7, 2005

(86) PCT No.: PCT/KR2005/000367

§ 371 (c)(1),
(2), (4) Date: Mar. 12, 2008

(87) PCT Pub. No.: WO2006/068343

PCT Pub. Date: Jun. 29, 2006

(65) Prior Publication Data

US 2008/0212326 A1 Sep. 4, 2008

(30) Foreign Application Priority Data

Dec. 21, 2004 (KR) ..... 10-2004-0109824

(51) Int. Cl.
*F21V 7/09* (2006.01)

(52) U.S. Cl. ..... 362/297; 362/304; 362/346

(58) Field of Classification Search ..... 362/263, 362/297, 298, 301, 304, 341–343, 346, 348–350; 313/25, 634

See application file for complete search history.

(56) References Cited

U.S. PATENT DOCUMENTS

| | | | | |
|---|---|---|---|---|
| 2,639,368 | A * | 5/1953 | Pryne | 362/364 |
| 4,914,557 | A * | 4/1990 | Maassen et al. | 362/305 |
| 5,800,050 | A * | 9/1998 | Leadford | 362/296.08 |
| 6,024,469 | A * | 2/2000 | Greif | 362/346 |
| 6,152,579 | A * | 11/2000 | Reed et al. | 362/320 |
| 6,176,597 | B1 * | 1/2001 | Smith | 362/297 |
| 6,242,851 | B1 * | 6/2001 | Zhu et al. | 313/25 |
| 6,464,378 | B1 * | 10/2002 | Reed et al. | 362/320 |

FOREIGN PATENT DOCUMENTS

| | | |
|---|---|---|
| JP | 14-109911 | 4/2002 |
| JP | 15-331620 | 11/2003 |

OTHER PUBLICATIONS

PCT International Search Report dated Sep. 28, 2005 issued in corresponding PCT Application No, PCT/KR2005/000367.

* cited by examiner

*Primary Examiner*—Thomas M Sember
(74) *Attorney, Agent, or Firm*—Ostrolenk Faber LLP

(57) ABSTRACT

The present invention relates to a lighting apparatus, and more particularly to a lighting apparatus including a frame in which a connector is installed, a lampshade in which a reflector, whose first and second anodized aluminum reflectors are integrally connected to each other and connected to the front side of the frame, is fixed to the inner circumference, and a lamp connected to the connector through a socket and having a cover to which the socket is connected and a luminous element connected to the inside of the cover, whereby illuminance is enhanced, the reflector is easily assembled, lifespan of a lamp is prevented from being shorter due to re-reflected light, reflectivity of the reflector is increased, and heating value is effectively reduced.

4 Claims, 23 Drawing Sheets

(a)

(b)

(c)

(a)

(b)

(c)

(a)

(b)

(c)

(a)

(b)

(a)

(b)

LIGHTING APPARATUS

CROSS REFERENCE TO RELATED APPLICATION

The present application is a 35 U.S.C. §§371 national phase conversion of PCT/KR2005/000367, filed Feb. 7, 2005, which claims priority of Korean Application No. 10-2004-0109824, filed Dec. 21, 2004. The PCT International Application was published in the English language.

TECHNICAL FIELD

The present invention relates to a lighting apparatus, and more particularly to a lighting apparatus including a frame in which a connector is installed, a lampshade in which a reflector, whose first and second anodized aluminum reflectors are integrally connected to each other and connected to the front side of the frame, is fixed to the inner circumference, and a lamp connected to the connector through a socket and having a cover to which the socket is connected and a luminous element connected to the inside of the cover, whereby illumination thereof is increased, the reflector is easily assembled, and the reflector is separated into several parts so as to prevent unnecessary waste.

BACKGROUND ART

Generally, lighting apparatuses are divided into a direct type lighting apparatus to directly heat a coil with a predetermined durability by supplying electric power to the coil, and an indirect type lighting apparatus to generate light using collision between fluorescent materials due to high voltage supplied to a tube filled with the fluorescent materials.

The generated light is reflected by the reflector lampshade, which is installed in the lighting apparatus, and illuminates a desired region so that a desired illuminance can be obtained.

However, the conventional lighting apparatus lights simply, and cannot generate sufficient illuminance because of light loss due to the reflector that reflects light only in one direction.

In order to overcome the above problem, a conventional lighting apparatus, as shown in FIG. 1, includes a box-shaped upper cap (10) which is integrally molded and to which a power cable is connected, and a reflecting cover (20) having a light diffuser (25) that is coupled to the lower side of the cap, which is installed to a surface facing a lamp to diffuse light generated from the lamp when the light is reflected by the reflecting cover, and that takes the form of an embossed semi-sphere, a quadrangular pyramid-shape, or the like.

However, according to the conventional light apparatus, since light generated by the lamp directly illuminates objects, shock is directly transmitted to electrodes and the electrodes are frequently broken when moving or installing the conventional light apparatus. Moreover, since the cap is integrally formed with the reflecting cover, unnecessary waste occurs because the entire apparatus must be replaced even when one component of the conventional lighting apparatus is damaged. Since it is difficult to manufacture the reflecting cover taking the form of the embossed shape, the quadrangular pyramid shape, or the like, manufacturing costs are increased.

Further, since the reflecting cover takes the form of the embossed shape, the quadrangular pyramid-shape, or the like, when light is generated by the lamp, the light arrives at the surface of the embossed, or quadrangular shaped reflecting cover and is directly reflected to a glass bulb of the lamp due to the angle of reflection. Thus, since the lamp heated to generate the light receives the reflected light, lifespan of the lamp is reduced and the reflectivity of the light is decreased.

DISCLOSURE

Technical Problem

Therefore, the present invention has been made in view of the above problems, and it is an object of the present invention to provide a lighting apparatus capable of enhancing luminance, of facilitating easy assembly of a reflector, of preventing lamp lifespan from being reduced due to re-reflected light, of increasing reflectivity of the reflector, and of effectively reducing heat generation.

Technical Solution

In accordance with an aspect of the present invention, the above and other objects can be accomplished by the provision of a lighting apparatus, including a box-shaped frame 100 including a rear vessel 102 and a rear cap 101 that are detachably mounted to the frame 100, and a connector 120 having a power cable 110 that is connected to the connector 120, a lampshade 200 coupled to the front side of the frame 100 and including a reflector 210 in which first reflectors 210*a*, 211*a*, and 212*a* and second reflectors 210*b*, 211*b*, and 212*b* are coupled with each other at the inside of a cover 220, the reflector 210 serving to guarantee maximal projecting range under 20 m direct-below luminance of a lamp, and a lamp 300 including a socket 370 that is rotated to be coupled with the connector 120 and is connected to the side of a cover 310 in which a luminous element 330 is installed, first and second electrodes 320*a* and 320*b* that are protruded from the inside of the cover 310 and support the luminous element 330 to supply electric power.

Hereinafter, materials of the first and second reflectors as components of the lighting apparatus according to the preferred embodiment of the present invention will be described in detail.

In the present invention, first and second reflectors are formed of anodized aluminum, as shown in FIG. 6, that is coated upon the first and second reflectors by physical vapor deposition. The anodized aluminum includes a lowest layer coated with materials such as titanium oxide ($TiO_2$), silicon (Si), or the like, a bonding layer formed on the lowest layer, a pure aluminum layer consisting of 99.99% pure aluminum and formed on the bonding layer, and a super reflective oxide layer, and exhibits excellent characteristics such as 94% to 95% total reflectivity, 80% to 90% diffuse-reflectance, and 80% to 92% brightness.

According to the present invention, an increase of 16.5%, from the 69.5% light output seen in a conventional lighting apparatus, to the 81% light output seen in the lighting apparatus according to the present invention, can be obtained by utilizing the anodized aluminum.

DESCRIPTION OF DRAWINGS

The above and other objects, features and other advantages of the present invention will be more clearly understood from the following detailed description taken in conjunction with the accompanying drawings, in which.

BEST MODE

Hereinafter, the preferred embodiments of the present invention will be described in detail with reference to the accompanying drawings.

Figure 1:
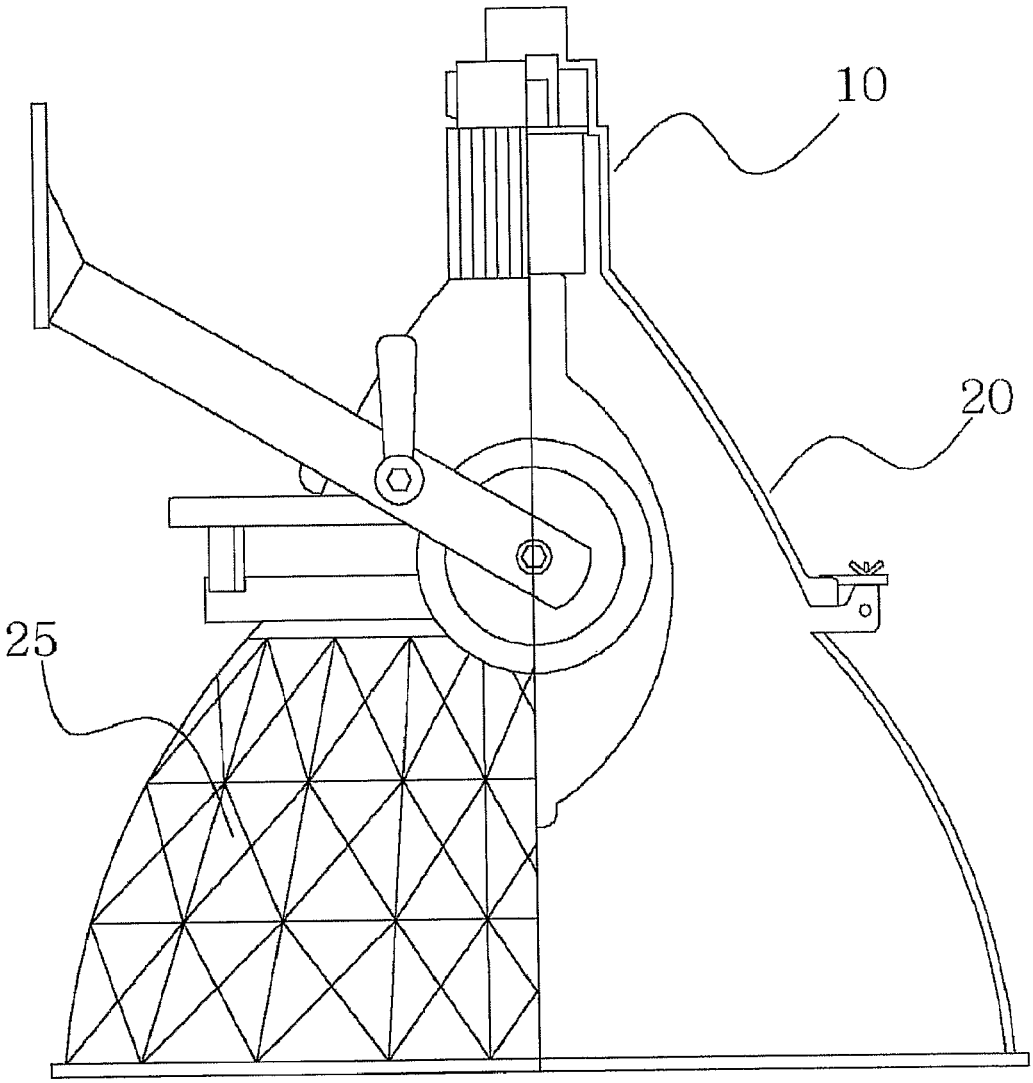
FIG. 1 is a perspective view illustrating a conventional lighting apparatus.
Figure 2:
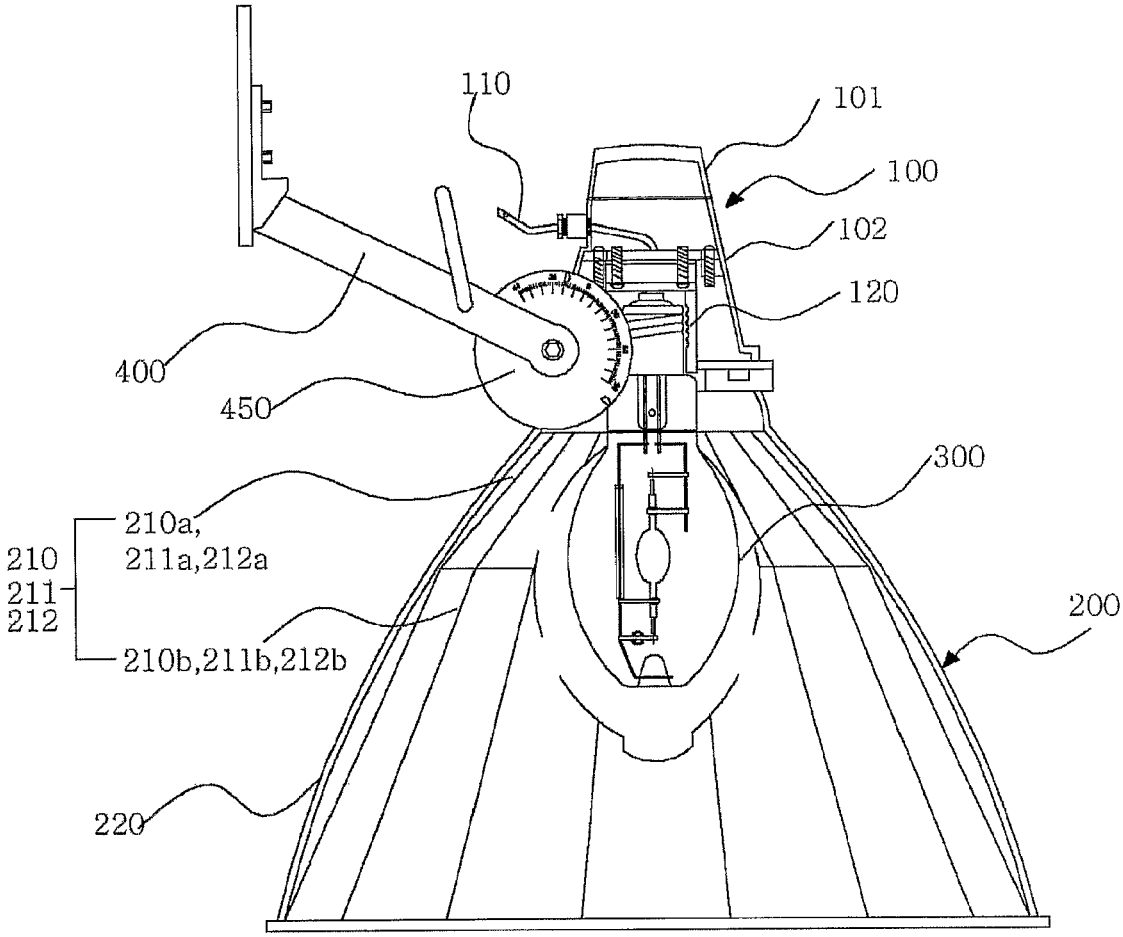
FIG. 2 is a perspective view illustrating a lighting apparatus according to the preferred embodiment of the present invention.

As shown in FIG. 2, a lighting apparatus according to the preferred embodiment of the present invention includes a frame 100, a lampshade 200, and a lamp 300.

The box-shaped frame 100 includes a rear vessel and a rear cap, which are detachably mounted at the upper side thereof, and a connector 120 fixed by screws and having a power cable 110 that is connected to the connector 120.

The lampshade 200 that is coupled to the front side of the frame 100 includes a reflector 210 in which first reflectors 210*a*, 211*a*, and 212*a* are integrally formed with a base 210*c* at the inside of the cover 220.

Figure 3A:
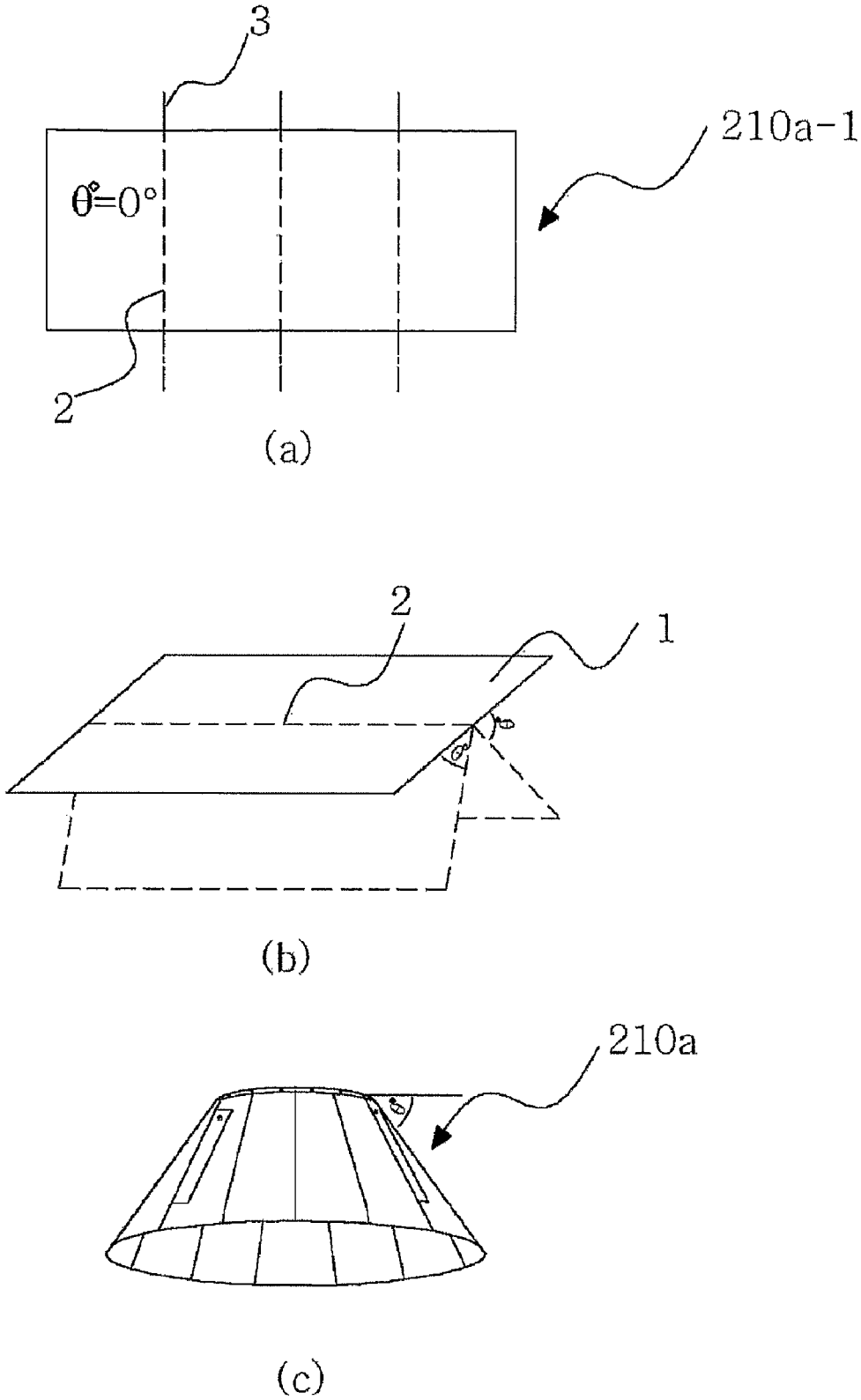
FIG. 3*a* is a view illustrating the manufacturing process of a first reflector of a reflector as a component of the lighting apparatus according to the preferred embodiment of the present invention.

The first reflector 210*a*, as shown in (a) of FIG. 3*a*, is manufactured such that a plurality of bending lines 2 are formed on the development drawing of an anodized aluminum to align with vertical reference lines (an angle of 0 degree) 3, the anodized aluminum is bent along the bending lines 2 formed on the vertical reference lines (an angle of 0 degree) 3 and, as shown in (b) of FIG. 3*a*, is downwardly bent from the horizontal plane 1 at angles of 1 degree to 89 degrees so as to form an individual reflective piece 210*a*-1, a plurality of individual reflective pieces 210*a*-1 are connected to each other, and as shown in (c) of FIG. 3*a*, the connected individual reflective pieces 210*a*-1 are downwardly bent at angles of 1 degree to 89 degrees to have a diameter which is gradually increased.

Figure 3B:
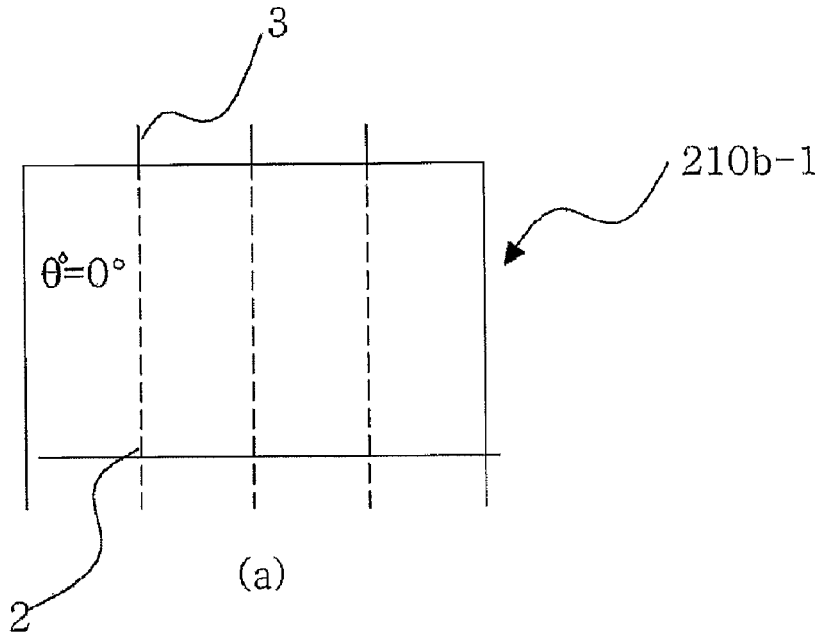
FIG. 3*b* is a view illustrating the manufacturing process of a second reflector of the reflector as a component of the lighting apparatus according to the preferred embodiment of the present invention.
Figure 3B:
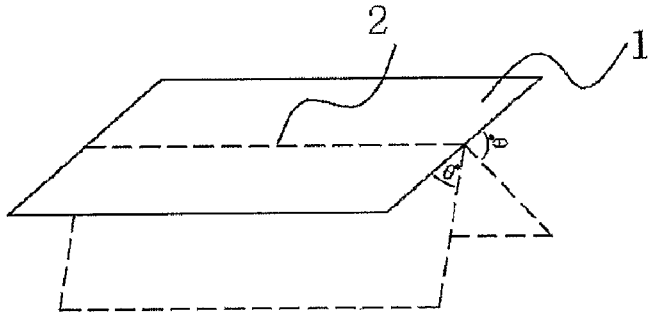
Figure 3B:
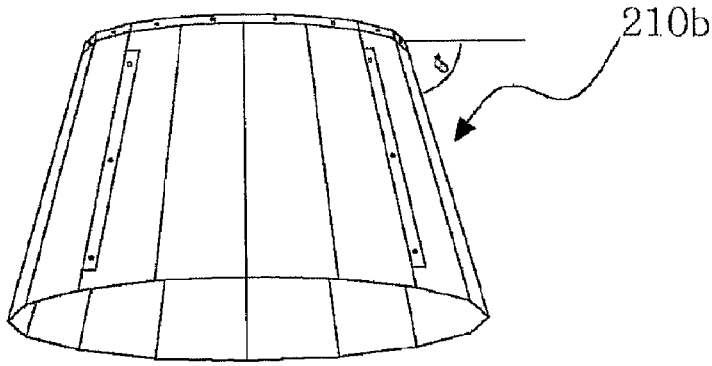

The second reflector 210*b*, as shown in (a) of FIG. 3*b*, is manufactured such that a plurality of bending lines 2 are formed on an unfolded anodized aluminum to align with vertical reference lines (an angle of 0 degree) 3, the anodized aluminum is bent along the bending lines 2 formed on the vertical reference lines (an angle of 0 degree) 3 and, as shown in (b) of FIG. 3*b*, is downwardly bent from the horizontal plane 1 at angles of 1 degree to 89 degrees so as to form an individual reflective piece 210*b*-1, a plurality of individual reflective pieces 210*b*-1 are connected to each other, and as shown in (c) of FIG. 3*b*, the connected individual reflective pieces 210*b*-1 are downwardly bent at angles of 1 degree to 89 degrees to have a diameter which is gradually increased.

Figure 3C:
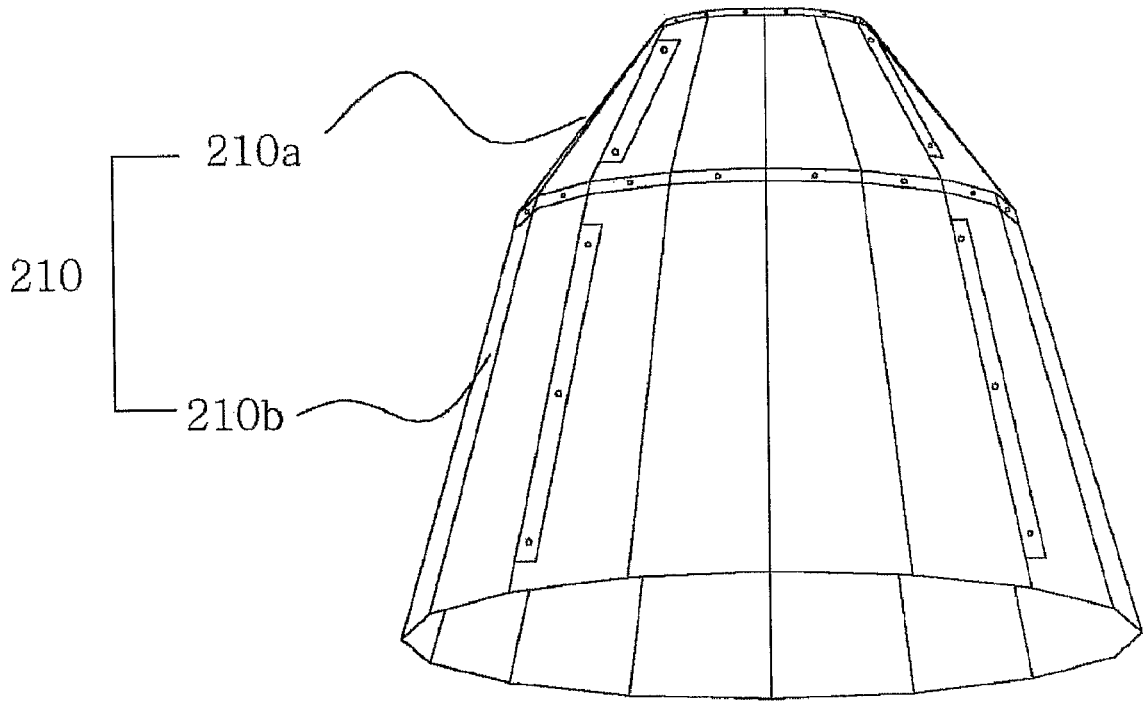
FIG. 3*c* is a perspective view of the reflector including the first reflector and the second reflector as components of the lighting apparatus according to the preferred embodiment of the present invention.
Figure 3D:
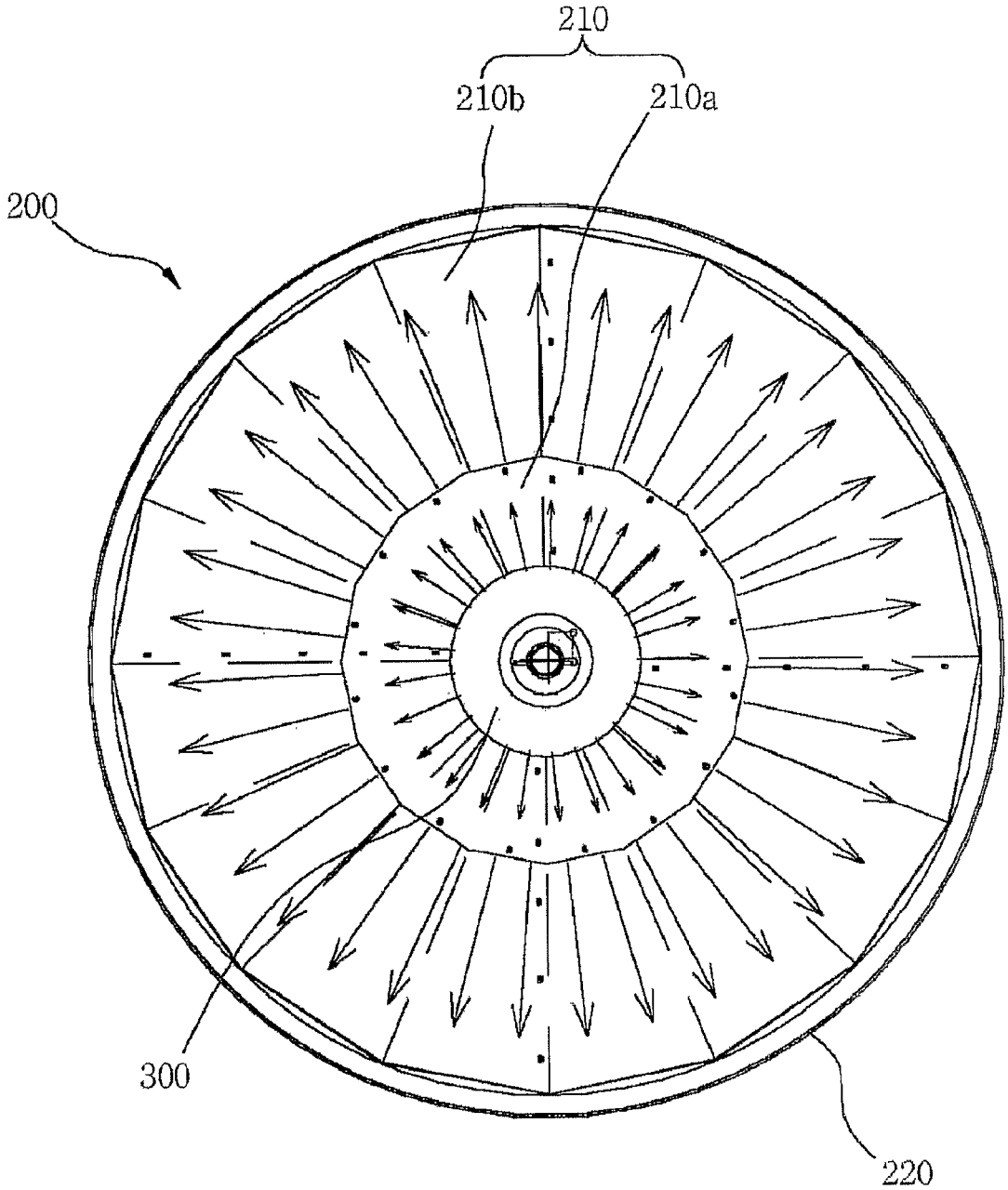
FIG. 3*d* is a view illustrating the interior of the reflector including the first reflector and the second reflector as components of the lighting apparatus according to the preferred embodiment of the present invention.

In the reflector 210, as shown in FIGS. 3*c* and 3*d*, since the bending lines that are formed in the reflector 210 including the first reflector 210*a* and the second reflector 210*b* are straightened, light emitted from a luminous element is reflected to the second reflector 210*b* via the first reflector to form a circle and gradually diffused.

Figure 4A:
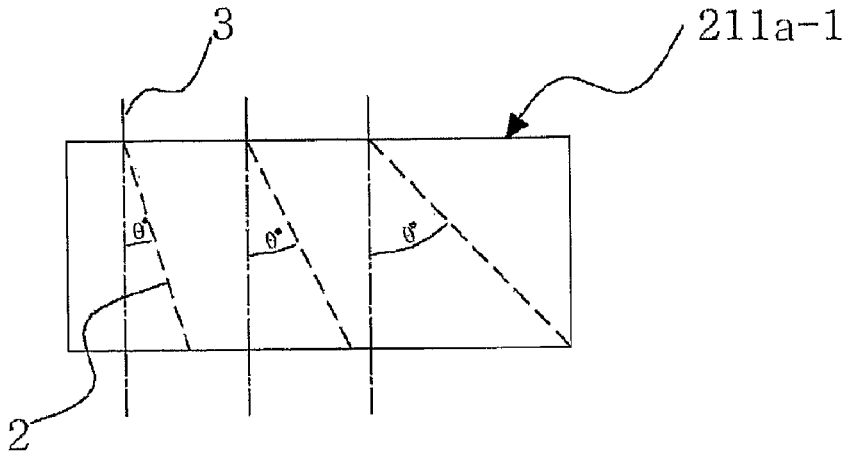
FIG. 4*a* is a view illustrating the manufacturing process of the first reflector of the reflector as a component of the lighting apparatus according to the preferred embodiment of the present invention.
Figure 4A:
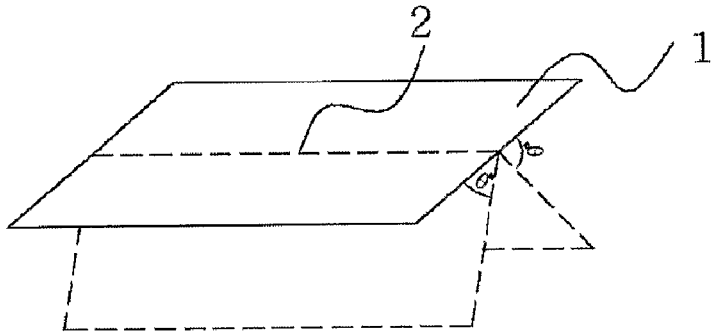
Figure 4A:
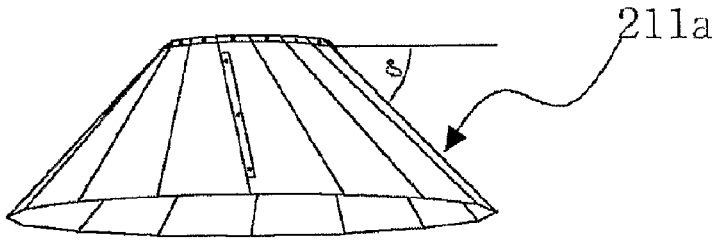

Moreover, as shown in (a) of FIG. 4*a*, the first reflector 211*a* is manufactured such that a plurality of inclined bending lines 2 are formed on an unfolded anodized aluminum to be slanted at angles of (±) 1 degree to 89 degrees from vertical reference lines (O degree angle) 3, the anodized aluminum is bent along the inclined bending lines 2 formed on the vertical reference lines (an angle of 0 degree) 3 and, as shown in (b) of FIG. 4*a*, is downwardly bent from the horizontal plane at angles of 1 degree to 89 degrees so as to form an individual reflective piece 211*a*-1, a plurality of individual reflective pieces 211*a*-1 are connected to each other, and as shown in (c) of FIG. 4*a*, the connected individual reflective pieces 211*a*-1 are downwardly bent at angles of 1 degree to 89 degrees to have a diameter which is gradually increased.

Figure 4B:
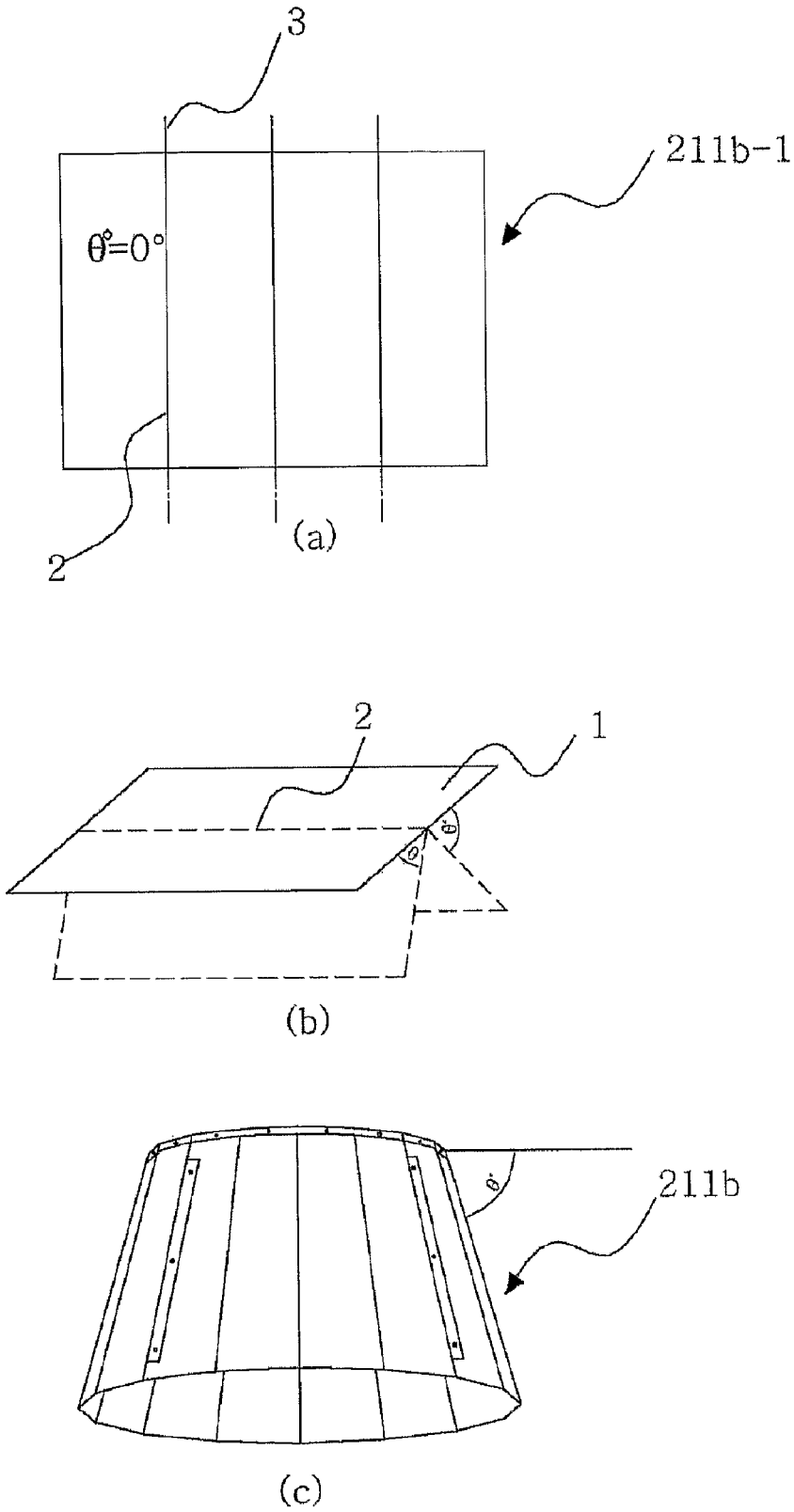
FIG. 4*b* is a view illustrating the manufacturing process of the second reflector of the reflector as a component of the lighting apparatus according to the preferred embodiment of the present invention.

The second reflector 211*b*, as shown in (a) of FIG. 4*b*, is manufactured such that a plurality of bending lines 2 are formed on an unfolded anodized aluminum to align with vertical reference lines (an angle of 0 degree) 3, the anodized aluminum is bent along the bending lines 2 formed on the vertical reference lines (an angle of 0 degree) 3 and, as shown in (b) of FIG. 4*b*, is downwardly bent from the horizontal plane at angles of 1 degree to 89 degrees so as to form an individual reflective piece 211*b*-1, a plurality of individual reflective pieces 211*b*-1 are connected to each other, and as shown in (c) of FIG. 4*b*, the connected individual reflective pieces 211*b*-1 are downwardly bent at angles of 1 degree to 89 degrees to have a diameter which is gradually increased.

Figure 4C:
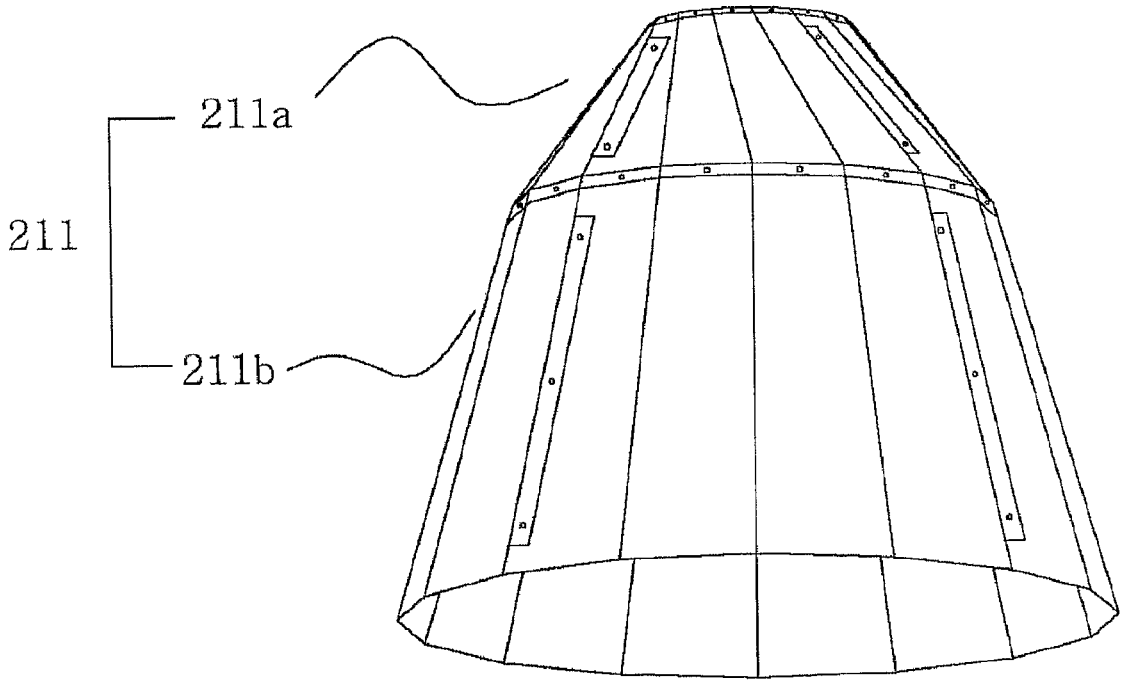
FIG. 4*c* is a perspective view illustrating the reflector that includes the first reflector and the second reflector as components of the lighting apparatus according to the preferred embodiment of the present invention.
Figure 4D:
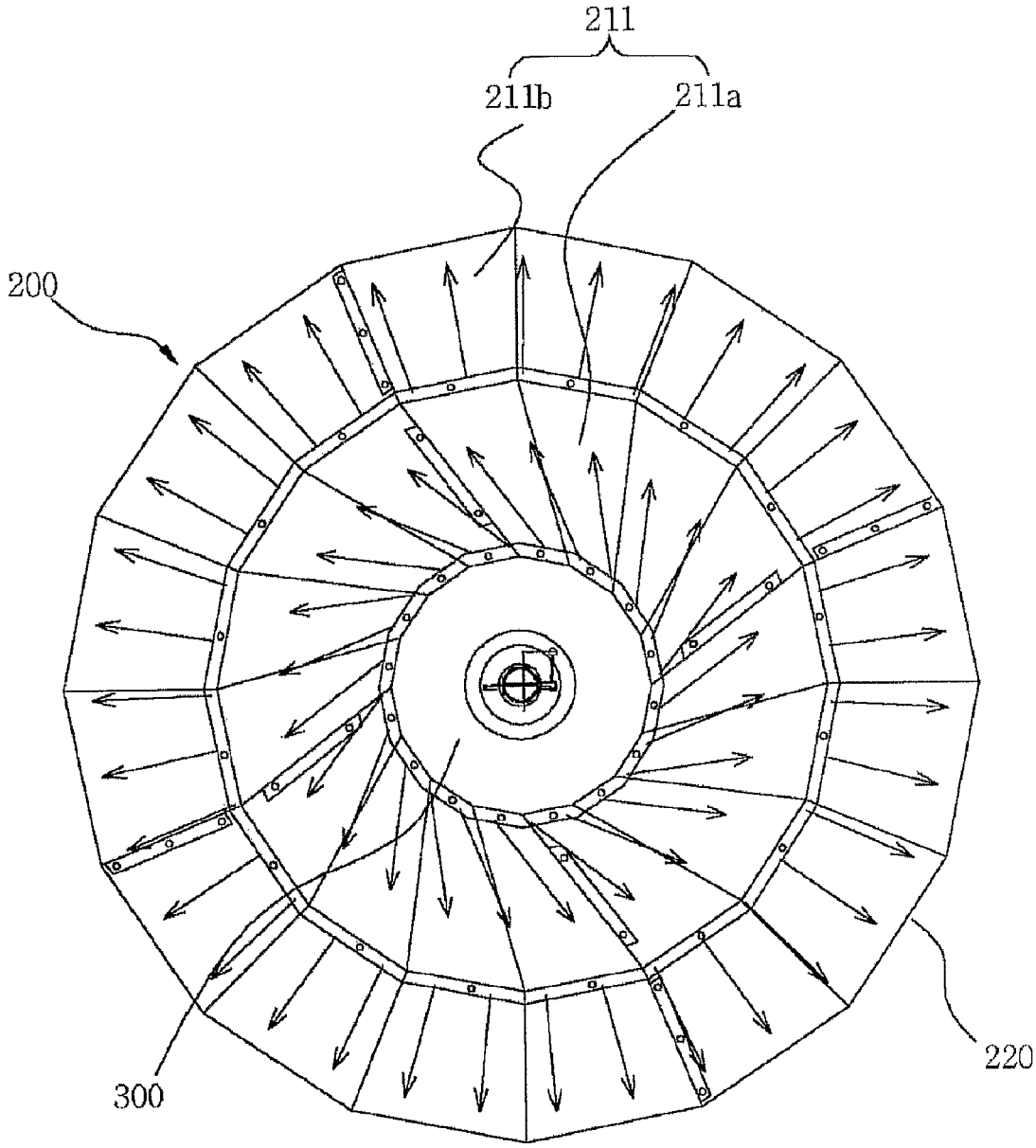
FIG. 4*d* is a view illustrating the interior of the reflector including the first reflector and the second reflector as components of the lighting apparatus according to the preferred embodiment of the present invention.

In the reflector 211, as shown in FIGS. 4*c* and 4*d*, since the inclined bending lines formed in the first reflector 211*a* are slanted in one direction and the bending lines formed in the second reflector 211*b* are straightened, light emitted from a luminous element is reflected in the slanted direction in the form of a vortex in the first reflector 211*a* and the vortex-like reflected light in the first reflector 211*a* is diffused to form a circle.

Figure 5A:
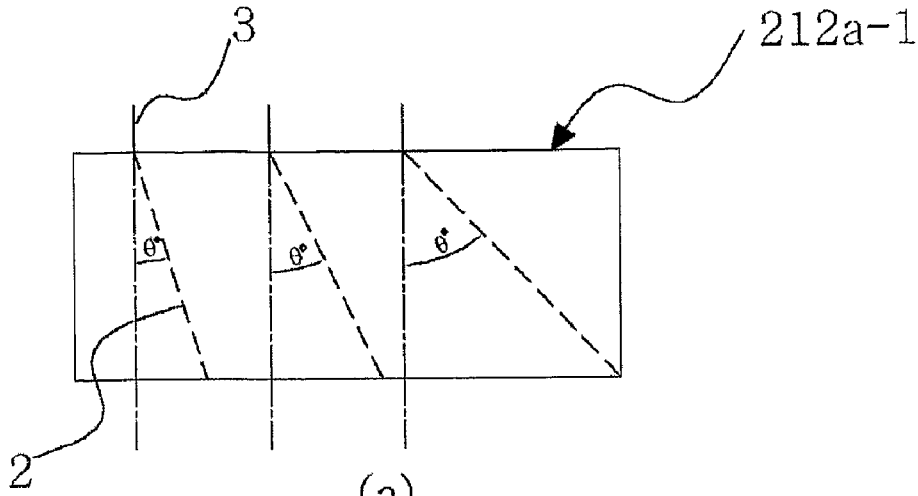
FIG. 5*a* is a view illustrating the manufacturing process of the first reflector of the reflector as a component of the lighting apparatus according to the preferred embodiment of the present invention.
Figure 5A:
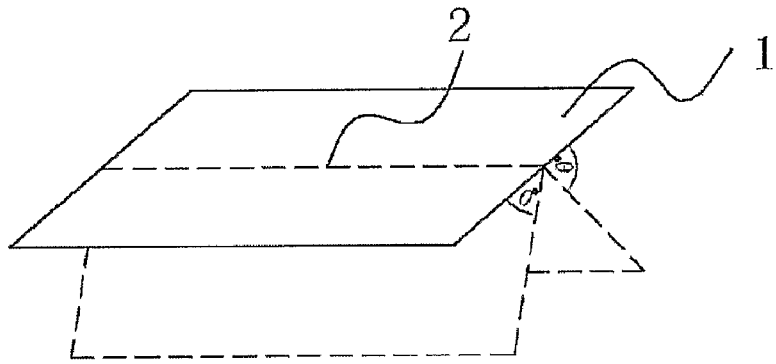
Figure 5A:
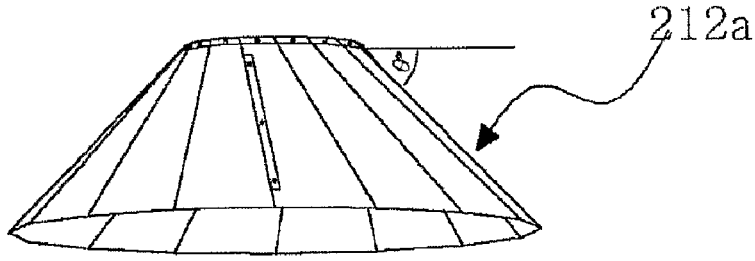

Moreover, as shown in (a) of FIG. 5*a*, the first reflector 212*a* is manufactured such that a plurality of inclined bending lines 2 are formed on an unfolded anodized aluminum to be slanted at angles of (±) 1 degree to 89 degrees from vertical reference lines (an angle of 0 degree) 3, the anodized aluminum is bent along the inclined bending lines 2 formed on the vertical reference lines (an angle of 0 degree) 3 and, as shown in (b) of FIG. 5*a*, is downwardly bent from the horizontal plane at angles of 1 degree to 89 degrees so as to form an individual reflective piece 212*a*-1, a plurality of individual reflective pieces 212*a*-1 are connected to each other, and as shown in (c) of FIG. 5*a*, the connected individual reflective pieces 212*a*-1 are downwardly bent at angles of 1 degree to 89 degrees to have a diameter which is gradually increased.

Figure 5B:
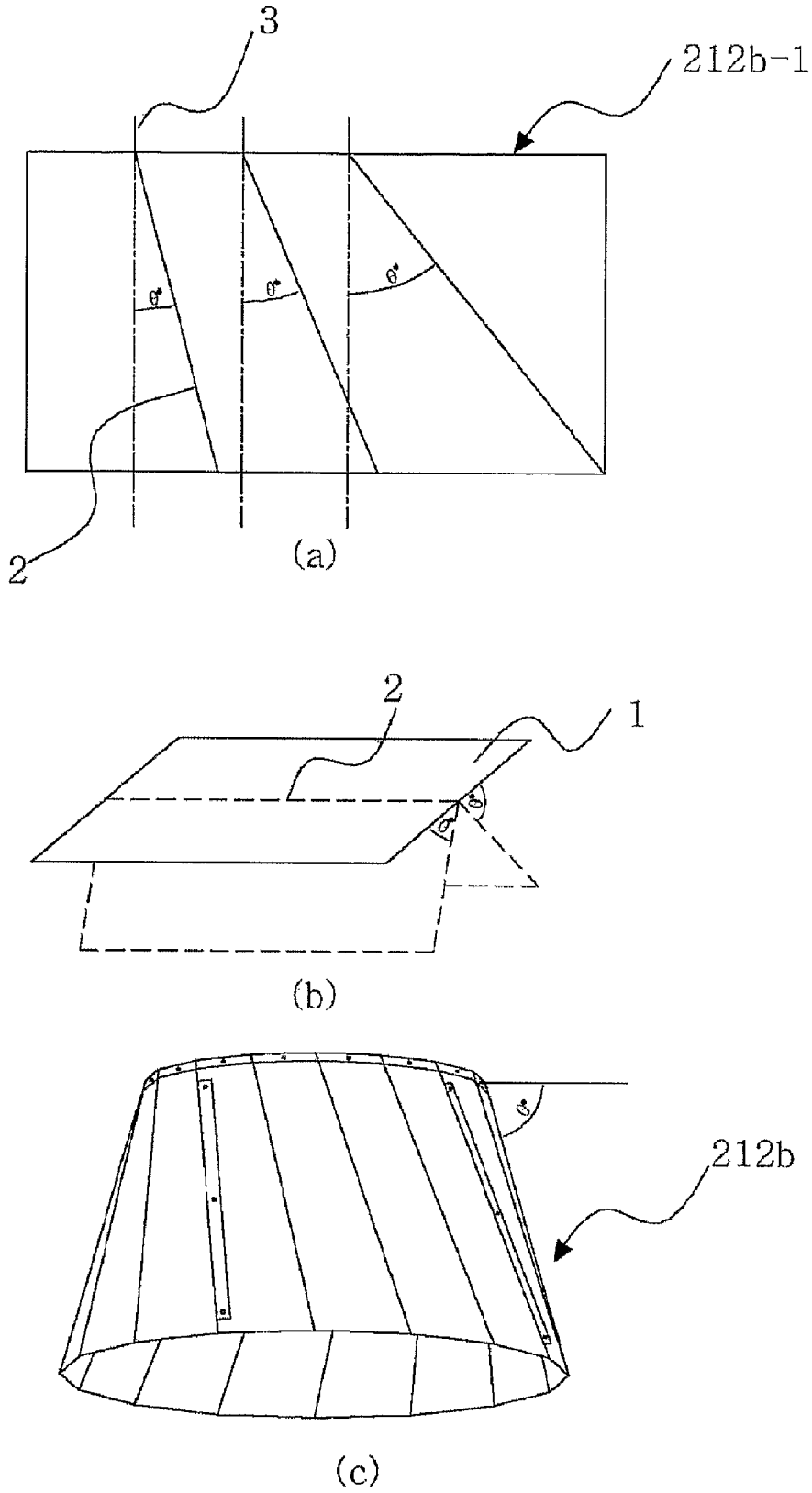
FIG. 5*b* is a view illustrating the manufacturing process of the second reflector of the reflector as a component of the lighting apparatus according to the preferred embodiment of the present invention.

The second reflector 212*b*, as shown in (a) of FIG. 5*b*, is manufactured such that a plurality of inclined bending lines 2 are formed on an unfolded anodized aluminum to be slanted at angles of (±) 1 degree to 89 degrees from vertical reference lines (an angle of 0 degree) 3, the anodized aluminum is bent along the inclined bending lines 2 formed on the vertical reference lines (an angle of 0 degree) 3 and, as shown in (b) of FIG. 5*b*, is downwardly bent from the horizontal plane at angles of 1 degree to 89 degrees so as to form an individual reflective piece 212*b*-1, a plurality of individual reflective pieces 212*b*-1 are connected to each other, and as shown in (c) of FIG. 5*b*, the connected individual reflective pieces 212*b*-1 are downwardly bent at angles of 1 degree to 89 degrees to have a diameter which is gradually increased.

Figure 5C:
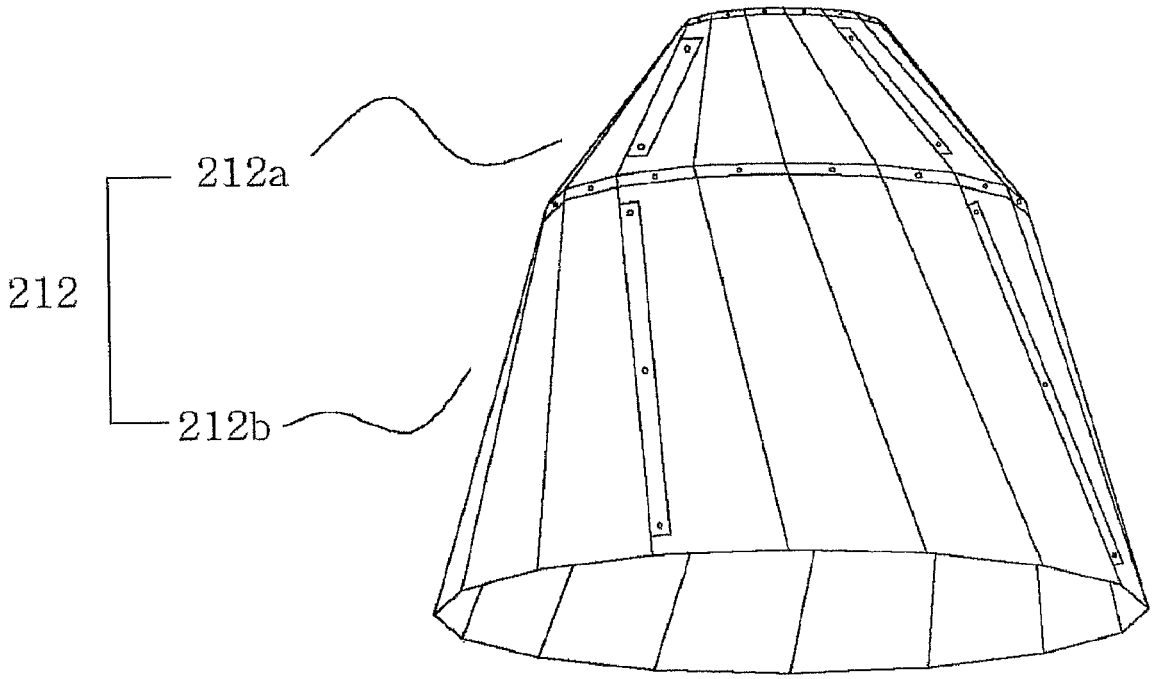
FIG. 5*c* is a perspective view illustrating the reflector that includes the first reflector and the second reflector as components of the lighting apparatus according to the preferred embodiment of the present invention.
Figure 5D:
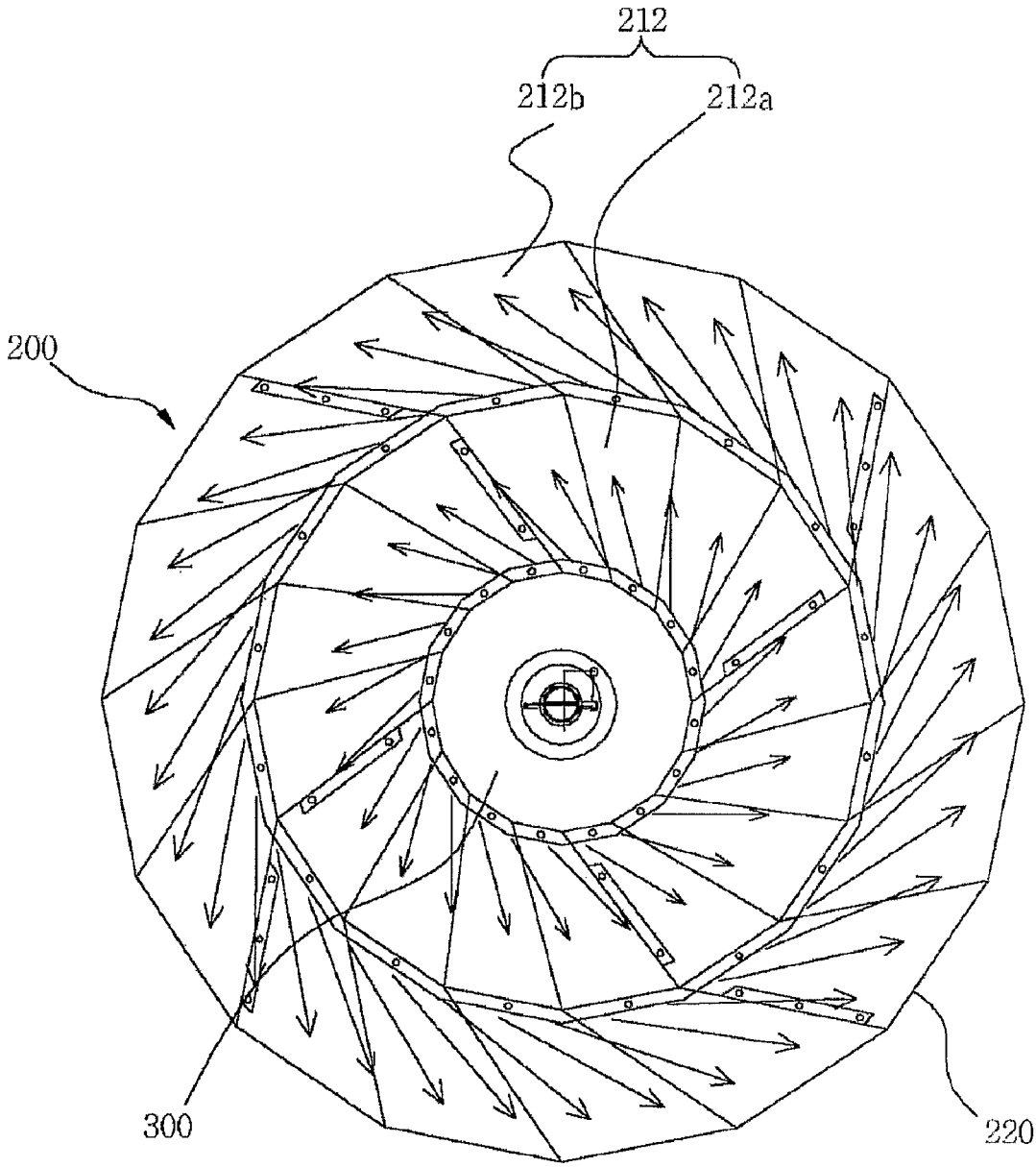
FIG. 5*d* is a view illustrating the interior of the reflector including the first reflector and the second reflector as components of the lighting apparatus according to the preferred embodiment of the present invention.

In the reflector 212, as shown in FIGS. 5*c* and 5*d*, since the inclined bending lines formed in the first reflector 212*a* are slanted in one direction and the bending lines formed in the second reflector 212*b* are also slanted in one direction, light emitted from a luminous element is reflected in the slanted direction in the form of a vortex in the first reflector 211*a* and the vortex-like reflected light in the first reflector 211*a* is reflected again in the form of a vortex and diffused.

Moreover, angles of the reflectors 210, 211, and 212 including the first reflectors 210*a*, 211*a*, and 212*a* and the second reflectors 210*b*, 211*b*, and 212*b* are adjusted according to distances between the lamp and light projecting planes, and preferably adjusted such that a maximal projecting range is guaranteed within 20 m.

The angles, as shown in FIG. 2, are adjusted by using an angle plate 450 being rotated to an angle of 90 degrees and mounted at the side of the rear vessel and a leg 400 attached to a wall.

The lamp 300 connected to the connector 120 includes a socket 370 joined to the side of the cover 310 to be rotated and coupled with the connector 120, first and second electrodes 320*a* and 320*b* protruded inside the cover 310, and a luminous element 330 spaced apart from the cover 310 and electrically connected to the electrodes 320*a* and 320*b* and having an arc tube 330*a*-1 which is filled with fluorophor.

The upper and lower sides of the luminous element 330 are supported by supporting pieces 340 and electrically connected to the electrodes 320*a* and 320*b* through electric wires 320*a*-1 and 320*b*-1. The lower side of the arc tube 330*a*-1 is connected to a heat preventing special cover 320, a heat radiator 350 is connected to the side of the second electrode 320*b*, a nonconductor 340*a* is disposed at the side of the supporting piece 340 to prevent conduction, and the protrusion 310*a* protrudes from the inside of the cover 310 and supports the side of the electrode 320*a*.

Here, the heat preventing special cover 320 is made of ceramic and installed to the upper and lower ends of the arc tube 330*a*-1 made of glass and iron. The heat preventing special cover 320 prevents heat generated from the arc tube 330*a*-1 from being transferred to the first and second electrodes 320*a* and 320*b* through the supporting pieces 340.

The heat radiator 350 includes a lead wire made of nickel, copper, and molybdenum and a base made of iron and nickel and prevents heat generated from the inside of the arc tube 330*a*-1 from being spread.

According to the present invention, since the heat preventing special cover 320 and the heat radiator 350 prevent heat generated from the arc tube from being spread, the lamp can be used for a long time.

The luminous element 330 is made of the vacuum arc tube filled with mercury, helium gas, or the like.

The oval structure of the lighting apparatus according to the preferred embodiment of the present invention will be described in detail.

As shown in FIG. 2, the frame 100 has a box shape such that the rear vessel 102 at the upper side and the rear cap 101 is detachably mounted and includes the connector 120 fixed by screws and having the power cable 110 that is connected to the connector 120.

Especially, the rear vessel 102 and the rear cap 101 at the upper side are improvements of the conventional rear vessel and the rear cap which are molded and integrally formed with each other, and that are hinged and fixed by screws. When components necessary to supply electric power are out of order due to a short-circuit and/or overcurrent, the broken-down components are easily replaced with other new components, so that the lighting apparatus according to the preferred embodiment of the present invention can be used for a long time.

Moreover, the cone-shaped lampshade 200 is coupled to the front side of the frame 100 to prevent the reflector 210 installed to the inside of the lampshade 200 from damage.

The reflector 210 includes the first reflectors 210*a*, 211*a*, and 212*a* and the second reflectors 210*b*, 211*b*, and 212*b* that have sides wider than the base 210*c* and sequentially connected to each other.

using the above reflector according to the preferred embodiment of the present invention in comparison with the conventional general lamp (a conventional lighting apparatus: 400 W/R) and the conventional high efficiency lamp (a conventional lighting apparatus: 400 W/BE).

Experimental results 1: High efficiency lamp having circular reflective angles according to the present invention

| Item | | Product | | |
|---|---|---|---|---|
| | | Conventional lighting apparatus with a general lamp (400 W/R) | Conventional lighting apparatus with a high efficiency lamp (400 W/BE) | High efficiency lamp with circular reflective angles (400 W/BE) |
| Total luminous Flux (lm) | | 34000 | 37470 | 37470 |
| Power consumption (W) | | 425 | 425 | 425 |
| Measured reflective efficiency (%) | | 73.6 | 72.4 | 88 |
| Ratio/ measured direct-below luminance (lx) | 2 m | 10107 | 13013(0.267 m) | 20474(0.918 m) |
| | 4 m | 2527 | 3253(0.535 m) | 5119(1.835 m) |
| | 6 m | 1123 | 1446(0.802 m) | 2275(2.753 m) |
| | 8 m | 632 | 813(1.070 m) | 1280(3.670 m) |
| | 10 m | 404 | 521(1.337 m) | 819(4.588 m) |
| | 12 m | 280 | 361(1.605 m) | 569(5.505 m) |
| Efficiency (reference to 12 m) (lx/W) | | 0.7 | 0.9 | 1.42 |
| Ratio (vs. conventional lighting apparatus) | | 1 | 1.29 | 2.03 |

In other words, as shown in FIGS. 3*c* and 3*d*, the first reflector 210*a* is bent downwardly from the horizontal plane at angles of 1 degree to 89 degrees to have a predetermined length and the bending lines 2 are formed on an unfolded first reflector 210*a* to align with vertical reference lines (an angle of 0 degree) 3. The first reflector 210*a* is manufactured such that at least two tapered individual reflective pieces 210*a*-1 having a width increased from the upper side to the lower side thereof and bent at angles of 1 degree to 89 degrees are connected to each other to form a lampshade having a diameter increased from the upper side to the lower side.

The lower side of the lampshade of the first reflector 210*a* is connected with the second reflector 210*b* that is bent downwardly from a horizontal plane at angles of 1 degree to 89 degrees to have a predetermined length and the bending lines 2 are formed on an unfolded second reflector 210*b* to align with vertical reference lines (an angle of 0 degree) 3. The second reflector 210*b* is manufactured such that at least two tapered individual reflective pieces 210*a*-1 having a width increased from the upper side to the lower side thereof and bent at angles of 1 degree to 89 degrees are connected to each other to form a lampshade having a diameter increased from the upper side to the lower side.

Figure 10:
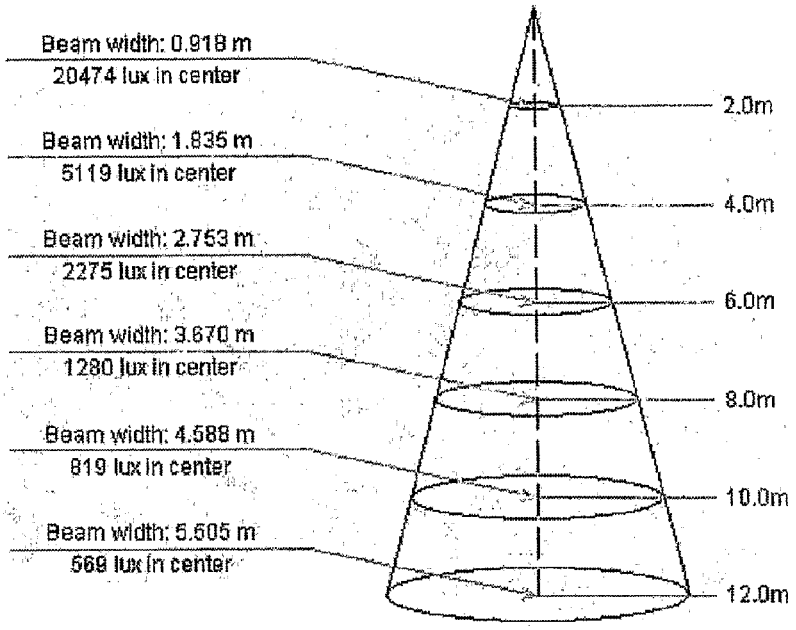
FIG. 10 is a view including a pattern view illustrating the direct-below illuminance and beam widths and a luminance intensity distribution diagram in the lighting apparatus according to the first embodiment of the present invention employing a plate-shaped reflector according to circular reflective angles.
Figure 10:
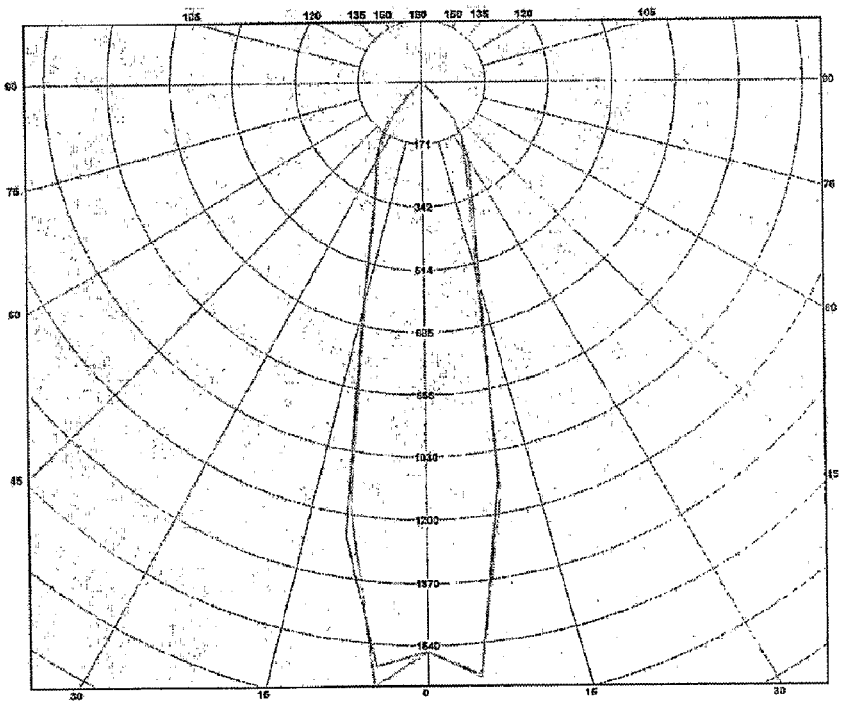

According to the reflector constructed as described above, light generated from the luminous element is reflected by the surface of the anodized aluminum in a circular form from the upper side to the lower side of the reflector, and the table below shows experimental results of the lighting apparatus As such, the direct-below luminance (lx) and beam width according to the height of the reflector in experimental results 1 can be illustrated by the pattern view (a) and the luminance intensity distribution diagram (b) as shown in FIG. 10.

As shown in the pattern view (a), in view of the direct-below luminance and the beam width according to the maximal projecting range (12 m) where light reaches the ground, it is understood that the direct-below luminance is 280 lx in the general lamp (conventional lighting apparatus), the direct-below luminance and the beam width in the high efficiency lamp (conventional lighting apparatus) are 361 lx and 1.605 m respectively, while the direct-below luminance and the beam width in the high efficiency lamp having the circular reflective angles according to the preferred embodiment of the present invention are 569 lx and 5.505 m, and its efficiency is 1.42.

Further, as shown in the luminance intensity distribution diagram (b), since the luminance intensity is widely spread at the upper side of the reflector and the direct-below luminance (lx) is gradually decreased toward the lower side of the reflector while the beam width is widened, it is understood that the luminance intensity is distributed such that its intermediate portion is convex.

Moreover, as shown in FIGS. 4*c* and 4*d*, the first reflector 211*a* is bent downwardly from the horizontal plane at angles of 1 degree to 89 degrees to have a predetermined length and the bending lines 2 are formed on an unfolded first reflector 211*a* to be slanted at angles of (±) 10 degrees to 50 degrees from vertical reference lines (an angle of 0 degree) 3. The first reflector 211*a* is manufactured such that at least two tapered individual reflective pieces 211*a*-1 having a width increased from the upper side to the lower side thereof and bent at angles of 1 degree to 89 degrees are connected to each other to form a lampshade having a diameter increased from the upper side to the lower side.

The lower side of the lampshade of the first reflector 211*a* is connected with the second reflector 211*b* that is bent downwardly from a horizontal plane at angles of 1 degree to 89 degrees to have a predetermined length and the bending lines 2 are formed on an unfolded second reflector 211*b* to align with vertical reference lines (an angle of 0 degree) 3. The second reflector 211*b* is manufactured such that at least two tapered individual reflective pieces 211*b*-1 having a width increased from the upper side to the lower side thereof and bent at angles of 1 degree to 89 degree are connected to each other to form a lampshade having a diameter increased from the upper side to the lower side.

According to the reflector constructed as above, light is diffused by the surface of the anodized aluminum in a semi-vortex form as shown in FIG. 4*d*.

Moreover, as shown in FIGS. 5*c* and 5*d*, the first reflector 212*a* is bent downwardly from the horizontal plane at angles of 1 degree to 89 degrees to have a predetermined length and the bending lines 2 are formed on an unfolded first reflector 212*a* to be slanted at angles of (±) 10 degrees to 50 degrees from vertical reference lines (an angle of 0 degree) 3. The first reflector 212*a* is manufactured such that at least two tapered individual reflective pieces 212*a*-1 having a width increased from the upper side to the lower side thereof and bent at angles of 1 degree to 89 degrees are connected to each other to form a lampshade having a diameter increased from the upper side to the lower side.

The lower side of the lampshade of the first reflector 212*a* is connected with the second reflector 212*b* that is bent downwardly from a horizontal plane at angles of 1 degree to 89 degree to have a predetermined length and the bending lines 2 are formed on an unfolded second reflector 212*b* to be slanted at angles of (±) 10 degrees to 50 degrees from vertical reference lines (an angle of 0 degree) 3. The second reflector 212*b* is manufactured such that at least two tapered individual reflective pieces 212*a*-1 having a width increased from the upper side to the lower side thereof and bent at angles of 1 degree to 89 degrees are connected to each other to form a lampshade having a diameter increased from the upper side to the lower side.

According to the reflector constructed as above, light is diffused by the surface of the anodized aluminum in a vortex form as shown in FIG. 4*d* and the following experimental results were obtained.

For reference, since the experimental results for the vortex-type reflector are similar to the experimental results in the semi-vortex type reflector, only the experimental results for the vertex-type reflector are provided.

Experimental results 2: A high efficiency lamp having the vortex-type reflector according to the preferred embodiment of the present invention.

| Total luminous flux (lm) | Power consumption (W) | Measured reflective efficiency (%) | Measured direct-below luminance (lx) 2 m | 4 m | 6 m | 8 m | 10 m | 12 m | Efficiency (reference to 12 m) (lx/W) | Ratio (vs conventional lighting apparatus = 1) |
|---|---|---|---|---|---|---|---|---|---|---|
| 37470 | 425 | 91.3 | 24284 (0.833 m) | 6071 (1.665 m) | 2698 (2.498 m) | 1518 (3.330 m) | 971 (4.163 m) | 675 (4.996 m) | 1.7 | 2.43 |

Figure 11:
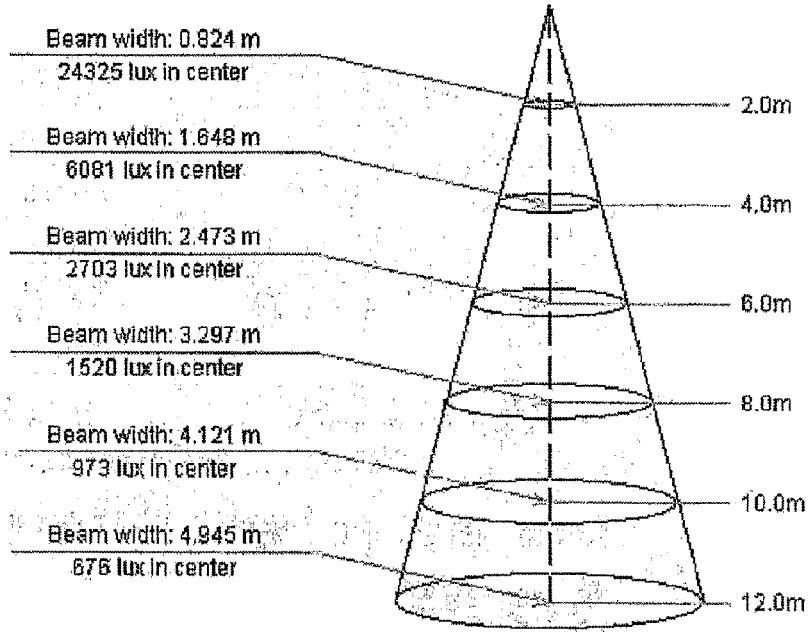
FIG. 11 is a view including a schematic view illustrating the direct-below illuminance and beam widths and a luminance intensity distribution diagram in the lighting apparatus according to the first embodiment of the present invention employing a vortex reflector
Figure 11:
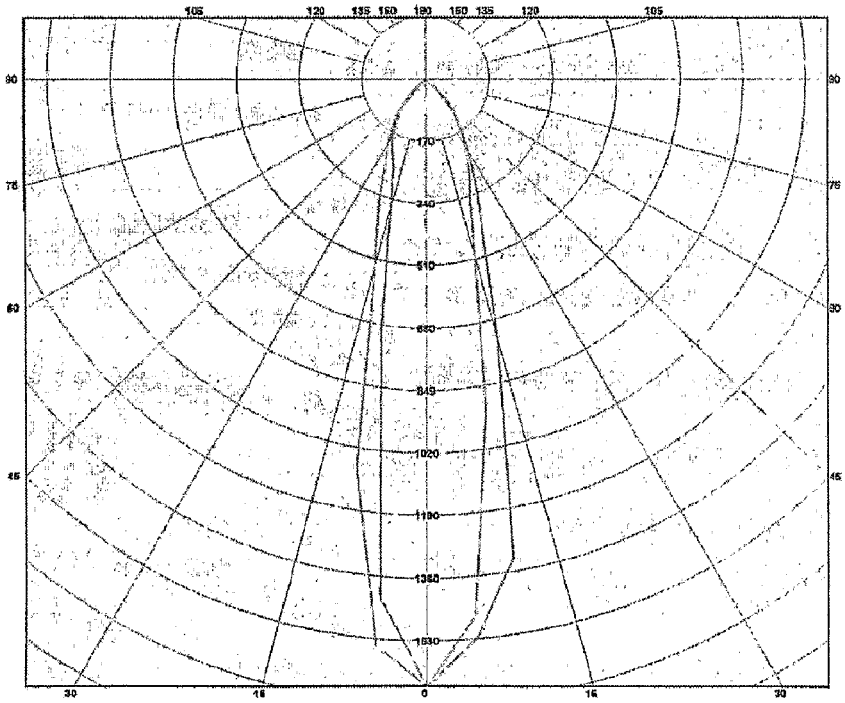

As such, the direct-below luminance (lx) and beam width according to the height of the reflector in the experimental results 2 can be illustrated by the pattern view (a) and the luminance intensity distribution diagram (b) as shown in FIG. 11.

As shown in the pattern view (a), in view of the direct-below luminance and the beam width according to the maximal projecting range (12 m) where light reaches the ground, it is understood that the direct-below luminance is 280 lx in the general lamp (conventional lighting apparatus), the direct-below luminance and the beam width in the high efficiency lamp (conventional lighting apparatus) are 361 lx and 1.605 m respectively, while the direct-below luminance and the beam width in the high efficiency lamp having the circular reflective angles according to the preferred embodiment of the present invention are 675 lx and 4.996 m, and its efficiency is 1.7.

Further, as shown in the luminance intensity distribution diagram (b), since the luminance intensity is widely spread at the upper side of the reflector and the direct-below luminance (lx) is gradually decreased toward the lower side of the reflector while the beam width is widened, it is understood that the luminance intensity is distributed such that it is approximately convex.

Figure 9:
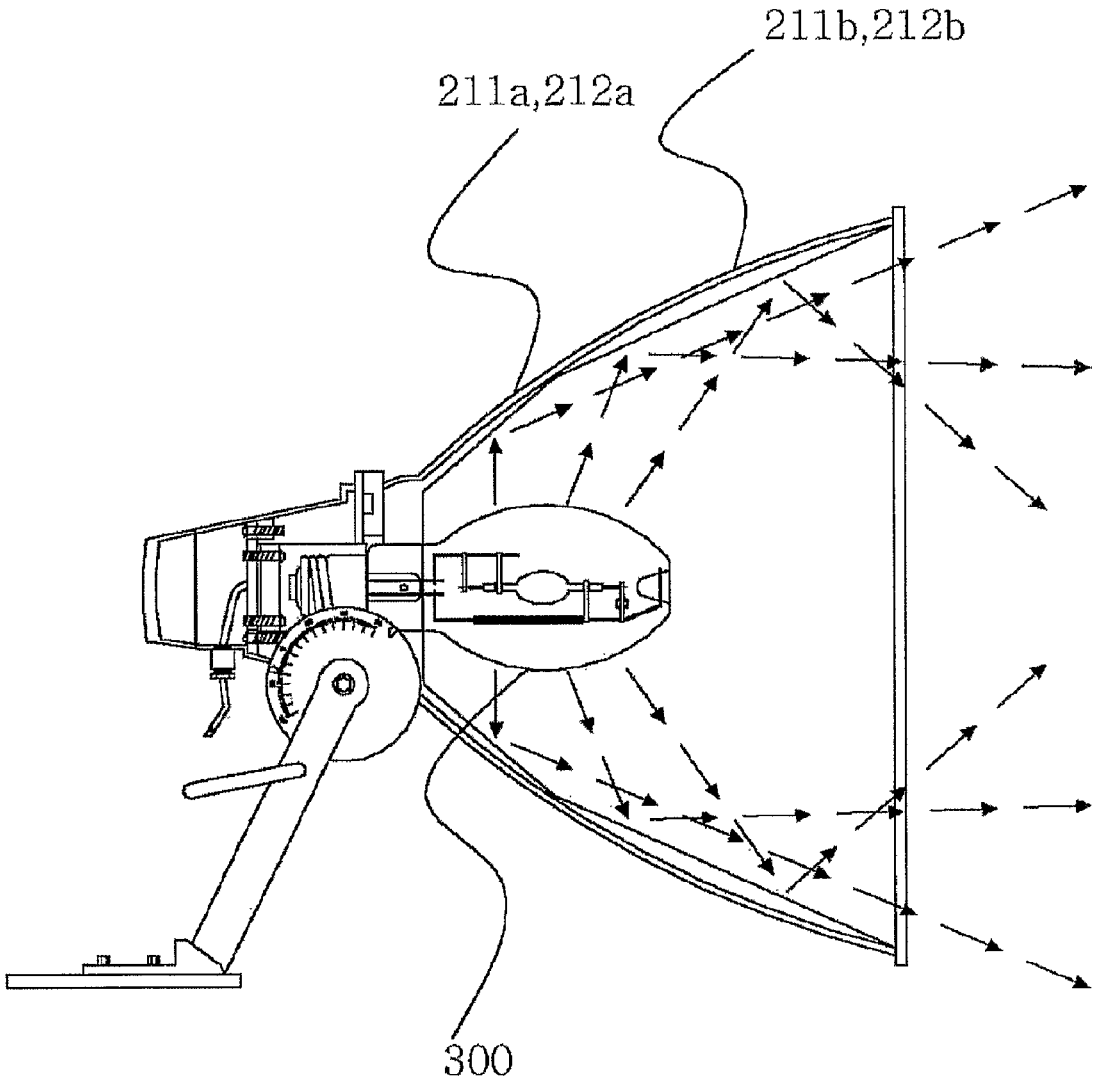
FIG. 9 is a view illustrating light reflection angles in a vortex reflector employed in the lighting apparatus according to the first embodiment of the present invention.

Moreover, in a high efficiency lighting apparatus having a vortex-type reflector or a semi-vortex-type reflector according to the present invention, as shown in FIG. 9, since the first reflectors 211*a* and 211*a* and the second reflectors 211*b* and 212*b* are formed to be slanted in one direction, light generated from the luminous element reaches the surface of the slanted reflector and is reflected in the form of vortex so that the reflected light is not reflected to the glass bulb of the lamp again, but takes the form of a vortex of which diameter is increased from the upper side of the reflector to the lower side of the reflector. Thus, since the heated lamp to generate the light does not receive the reflected light, life span of the lamp is prolonged.

The lamp 300 that is connected to the connector 120 includes the socket 370 joined to the side of the cover 310 to be rotated and coupled with the connector 120, the first and second electrodes 320*a* and 320*b* protruded into the cover 310, and the luminous element 330 spaced apart from the cover 310 and electrically connected to the electrodes 320*a* and 320*b* and having the arc tube 330*a*-1 which is filled with fluorophor.

The upper and lower sides of the luminous element 330 are supported by supporting pieces 340 and electrically connected to the electrodes 320*a* and 320*b* through electric wires 320*a*-1 and 320*b*-1. The lower side of the arc tube 330*a*-1 is connected to a heat preventing special cover 320, the heat radiator 350 is connected to the side of the second electrode 320*b*, the nonconductor 340*a* is disposed at the side of the supporting piece 340 to prevent conduction, and the protrusion 310*a* protrudes from the inside of the cover 310 and supports the side of the electrode 320*a*.

Figure 3E:
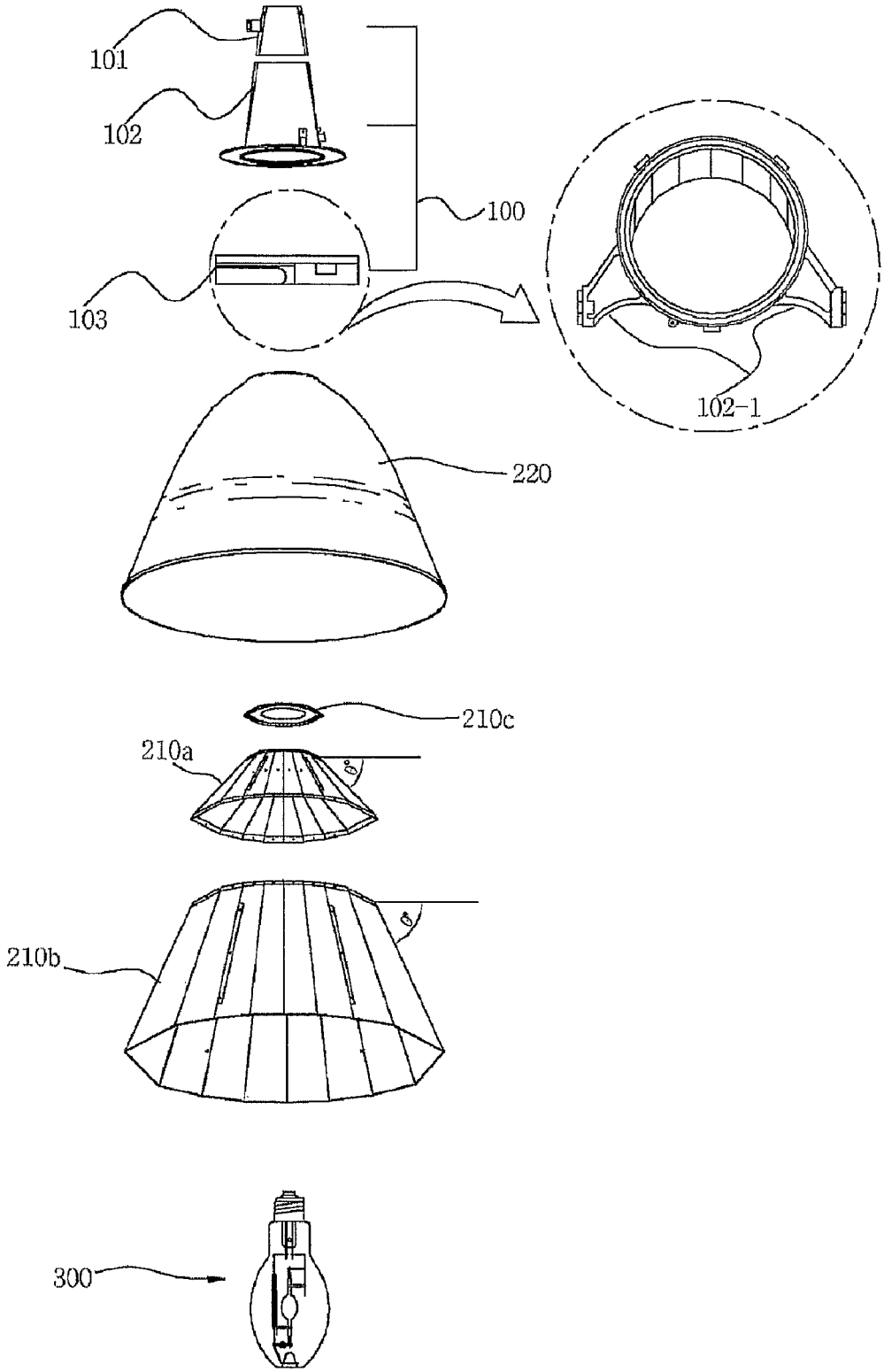
FIG. 3*e* is a perspective view illustrating assembly of the reflector that includes the first reflector and the second reflector.
Figure 4E:
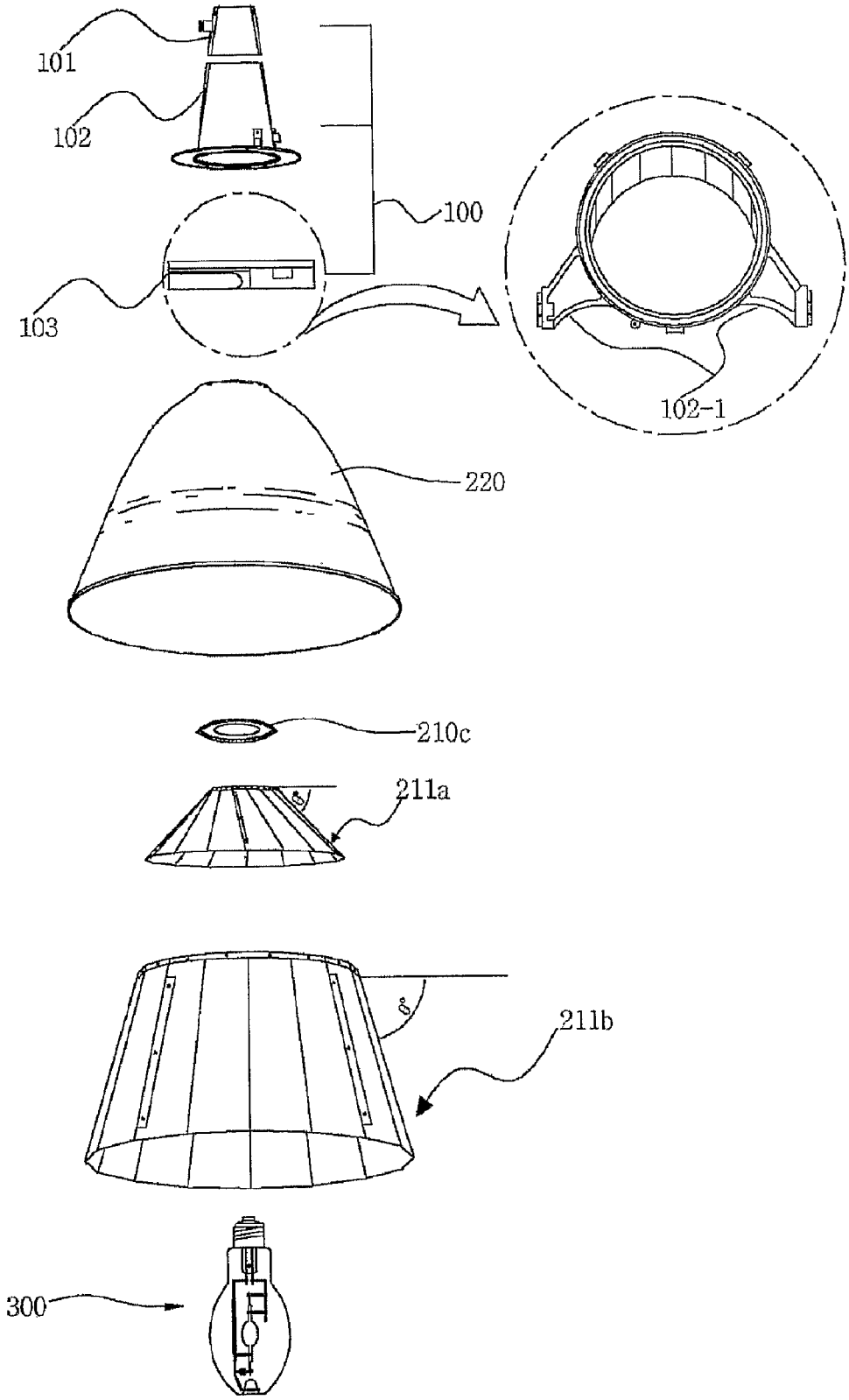
FIG. 4*e* is a perspective view illustrating assembly of the reflector that includes the first reflector and the second reflector.
Figure 5E:
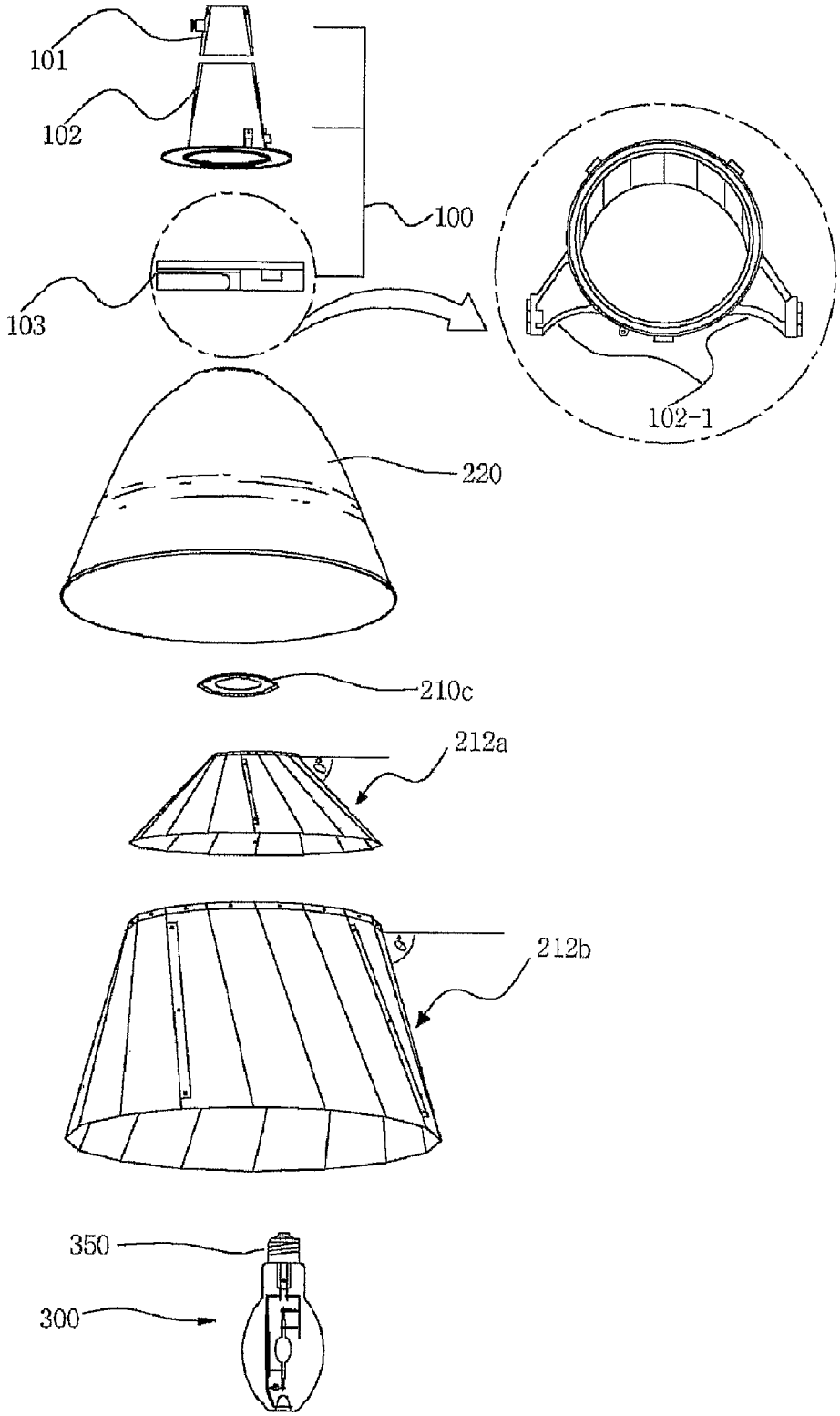
FIG. 5*e* is a perspective view illustrating assembly of the reflector that includes the first reflector and the second reflector.
Figure 6:
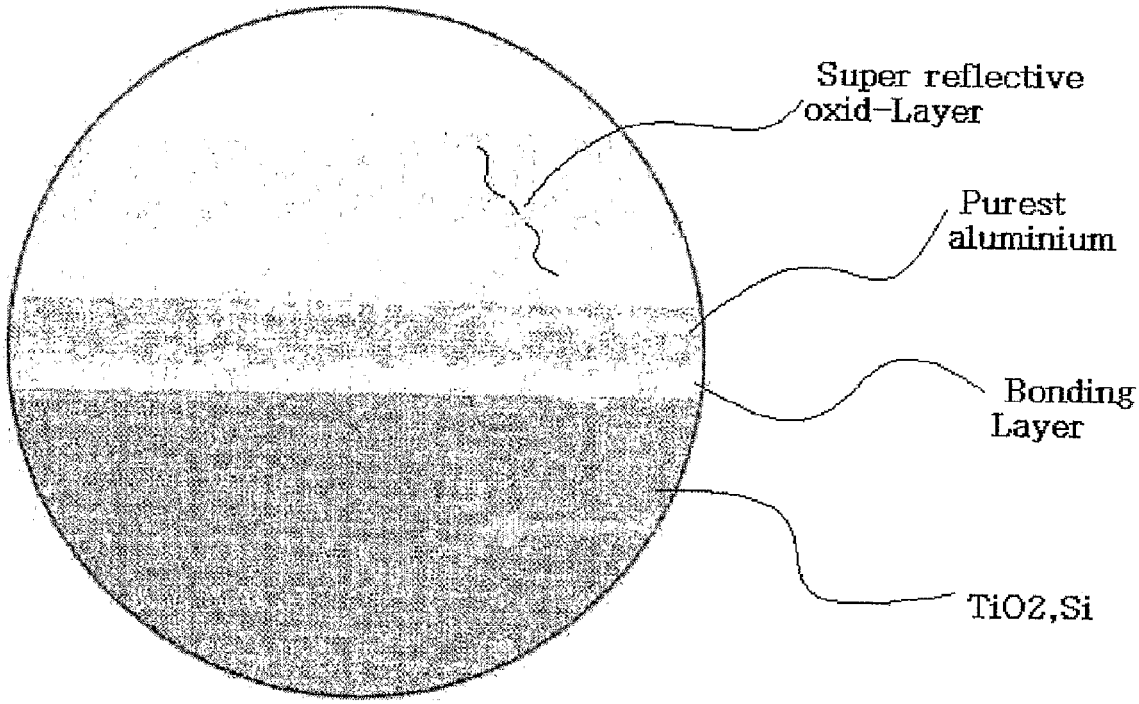
FIG. 6 is a view illustrating the structure of anodized aluminum coated by physical vapour deposition as a material for the reflector as a component of the lighting apparatus according to the preferred embodiment of the present invention.
Figure 7:
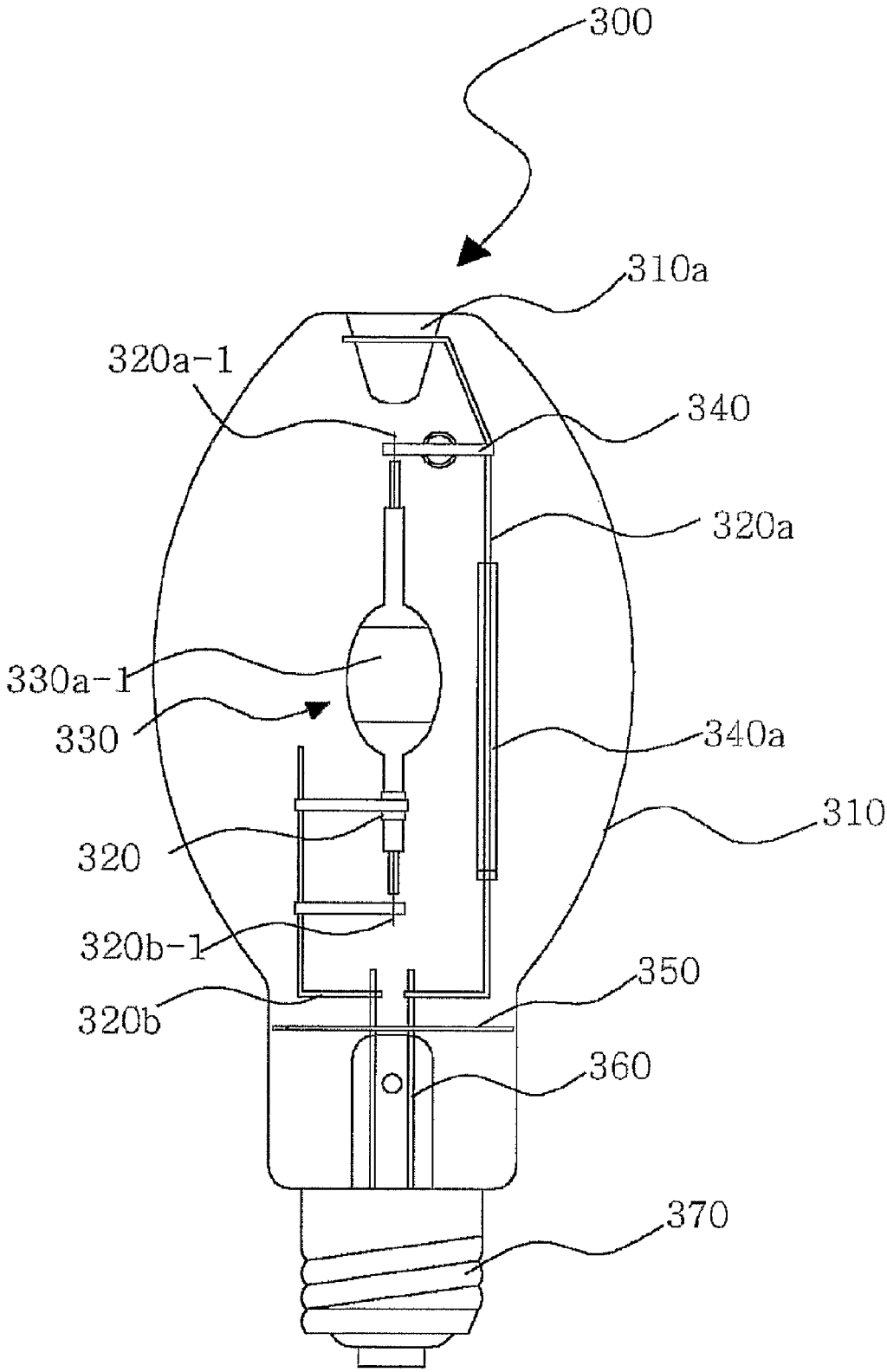
FIG. 7 is a perspective view illustrating the lamp employed in the lighting apparatus according to the preferred embodiment of the present invention.

In the lighting apparatus constructed as above according to the present invention, as shown in FIGS. 3*e*, 4*e*, and 5*e*, a molded ring including a power cable and a socket 102-1 is screwed to the frame 100 at the upper side of the lighting apparatus, the cover of the lampshade is coupled with the lower side of the molded ring, the first reflectors 210*a*, 211*a*, and 212*a*, the second reflectors 210*b*, 211*b*, and 212*b*, and the base 210*c* are coupled with the lower side of the cover of the lampshade, and the lamp 300 is coupled with the base 210*c*.

Figure 8:
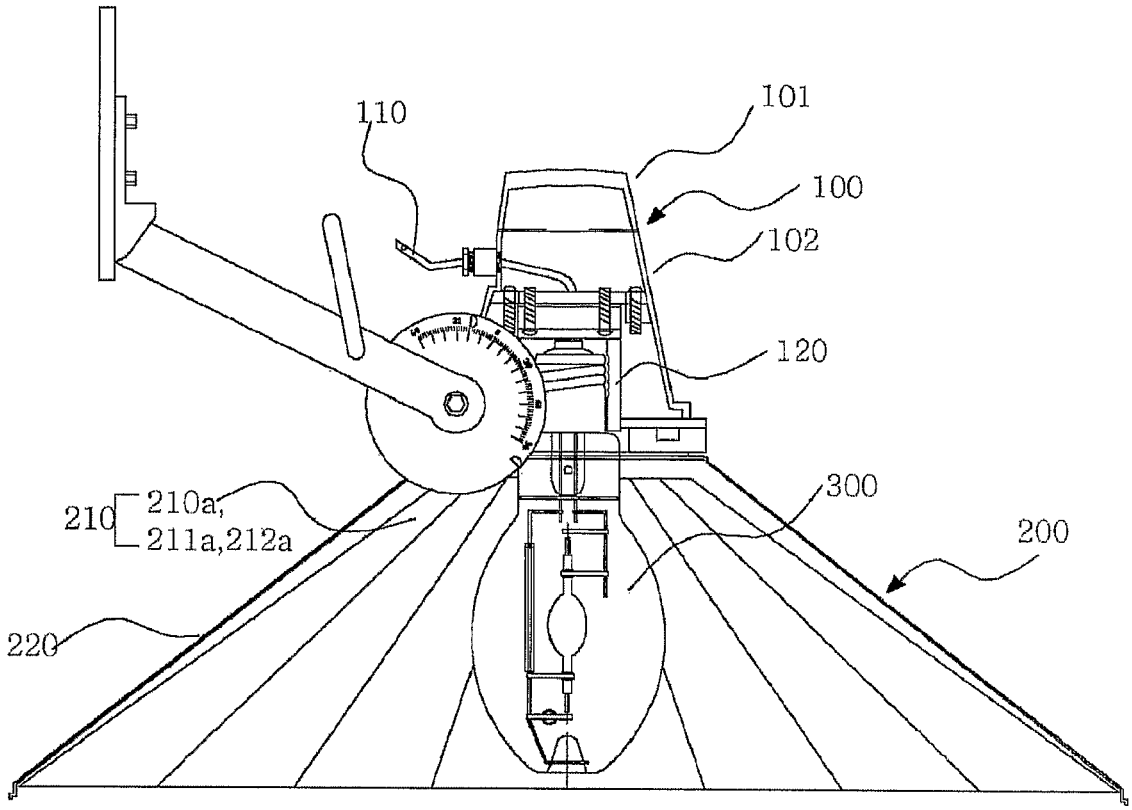
FIG. 8 is a view illustrating a lighting apparatus designed by using a first reflector according to a first embodiment of the present invention.

A lighting apparatus according to another embodiment of the present invention, as shown in FIG. 8, includes a molded ring having a power cable and a socket 120-1 and screwed to a frame 100 at the upper side of the lighting apparatus, a cover of a lampshade that is coupled with the lower side of the molded ring, first reflectors 210*a*, 211*a*, and 212*a* that are coupled with the lower side of the cover of the lampshade, a base 210*c* that is coupled to the first reflectors 211*a* and 212*a*, and the lamp 300 that is coupled with the base 210*c*.

INDUSTRIAL APPLICABILITY

As described above, according to the present invention, the lamp and the lighting apparatus can be used for a long time and heating value can be reduced. Reflectivity of light generated from the lamp is optimized to enhance luminance of the lighting apparatus. The individual reflective pieces are connected to each other so that the reflectors are easily assembled. Since the lamp includes the cover and the luminous element, lamp shorting is prevented to prolong the lifespan of the lamp. Since the reflector may be easily repaired, simply by replacing individual reflective pieces thereof, it is not necessary to replace the entire reflector as in conventional lighting apparatuses.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A lighting apparatus, comprising:

a box-shaped frame including a rear vessel and a rear cap that are detachably mounted to the frame, and a connector having a power cable that is connected to the connector;

a lampshade coupled to the front side of the frame, the lampshade including a reflector in which first and second reflectors are coupled with each other; and a lamp coupled with the connector, wherein:

the first reflector is an anodized aluminum reflector which is bent along a plurality of inclined bending lines formed relative to vertical reference lines having an angle of 0 degrees, the plurality of the inclined bending lines being formed on the anodized aluminum reflector of an unfolded state so as to be slanted at angles of ±1 degree to 89 degrees from the vertical reference lines, and being downwardly bent from the horizontal plane at angles of 1 degree to 89 degrees so as to form an individual reflective piece between the bending lines, a plurality of individual reflective pieces are connected to each other, and the connected individual reflective pieces are downwardly bent at angles of 1 degree to 89 degrees to have a diameter which is gradually increased; and the second reflector is an anodized aluminum reflector which is bent along a plurality of bending lines of the second reflector and formed relative to vertical reference lines having an angle of 0 degrees, the plurality of the bending lines of the second reflector being formed on the anodized aluminum reflector of an unfolded state to align with the vertical reference lines and is downwardly bent from the horizontal plane at angles of 1 degree to 89 degrees so as to form an individual reflective piece, a plurality of individual reflective pieces are connected to each other, and the connected individual reflective pieces are downwardly bent at angles of 1 degree to 89 degrees to have a diameter which is gradually increased.

2. The lighting apparatus of claim 1, wherein the lamp includes a socket that is rotated to be coupled with the connector and is connected to a side of a cover in which a luminous element and first and second electrodes that are protruded from an inside of the cover and support the luminous element to supply electric power, are installed, upper and lower sides of the luminous element are supported by supporting pieces and electrically connected to the electrodes through electric wires, a lower side of an arc tube is connected to a heat preventing special cover, a heat radiator is connected to a side of the second electrode, a nonconductor is disposed at a side of the supporting piece to prevent conduction, and a protrusion protruding from the inside of the cover supports a side of the first electrode.

3. A lighting apparatus, comprising:

a box-shaped frame including a rear vessel and a rear cap that are detachably mounted to the frame, and a connector having a power cable that is connected to the connector;

a lampshade coupled to the front side of the frame, the lampshade including a reflector in which first and second reflectors are coupled with each other; and a lamp coupled with the connector, wherein:

the first reflector is an anodized aluminum reflector which is bent along a plurality of inclined bending lines formed relative to vertical reference lines having an angle of 0 degrees), the plurality of the inclined bending lines being formed on the anodized aluminum reflector at an unfolded state so as to be slanted at angles of ±1 degree to 89 degrees from the vertical reference lines and being downwardly bent from a horizontal plane at angles of 1 degree to 89 degrees so as to form an individual reflective piece between the bending lines, a plurality of individual reflective pieces are connected to each other, and the connected individual reflective pieces are downwardly bent at angles of 1 degree to 89 degrees to have a diameter which is gradually increased; and the second reflector is an anodized aluminum reflector which is bent along a respective plurality of inclined bending lines formed relative to the vertical reference lines having an angle of 0 degrees and being downwardly bent from the horizontal plane at angles of 1 degree to 89 degrees so as to form an individual reflective piece between the bending lines of the second reflector, a plurality of individual reflective pieces of the second reflector are connected to each other, and the connected individual reflective pieces of the second reflector are downwardly bent at angles of 1 degree to 89 degrees to have a diameter which is gradually increased.

4. The lighting apparatus of claim 3, wherein the lamp includes a socket that is rotated to be coupled with the connector and is connected to a side of a cover in which a luminous element and first and second electrodes that are protruded from an inside of the cover and support the luminous element to supply electric power, are installed, a lower side of an arc tube is connected to a heat preventing special cover, a heat radiator is connected to a side of the second electrode, a nonconductor is disposed at a side of the supporting piece to prevent conduction, and including a protrusion protruding from the inside of the cover and supports the side of the first electrode.

* * * * *